US008150281B2

(12) United States Patent
Kawaguchi et al.

(10) Patent No.: US 8,150,281 B2
(45) Date of Patent: Apr. 3, 2012

(54) IMAGE FORMING APPARATUS

(75) Inventors: Hiroshi Kawaguchi, Numazu (JP); Hisashi Enomoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 389 days.

(21) Appl. No.: 12/395,122

(22) Filed: Feb. 27, 2009

(65) Prior Publication Data

US 2009/0214241 A1 Aug. 27, 2009

(30) Foreign Application Priority Data

Feb. 27, 2008 (JP) ..... 2008-045519

(51) Int. Cl.
*G03G 15/00* (2006.01)

(52) U.S. Cl. ..... 399/49; 399/300; 399/308

(58) Field of Classification Search ..... 399/9, 38, 399/49, 66, 72, 75, 299–303, 308
See application file for complete search history.

(56) References Cited

U.S. PATENT DOCUMENTS 5,072,244 A 12/1991 Aoki
5,926,669 A * 7/1999 Sugimoto et al. ..... 399/66
6,181,892 B1 * 1/2001 Fujimori ..... 399/72
2001/0031148 A1 * 10/2001 Kajiwara et al. ..... 399/49
2003/0063928 A1 * 4/2003 Matsuguma ..... 399/299

FOREIGN PATENT DOCUMENTS

| | | |
|---|---|---|
| JP | 2655603 | 9/1997 |
| JP | 2003-66660 | 3/2003 |
| JP | 2003-228217 | 8/2003 |
| JP | 2007-11184 | 1/2007 |

* cited by examiner

*Primary Examiner* — David Porta
*Assistant Examiner* — Benjamin Schmitt
(74) *Attorney, Agent, or Firm* — Canon USA Inc IP Division

(57) ABSTRACT

In the case where a peripheral velocity of photosensitive drums differs from a peripheral velocity of an intermediate transfer belt, the peripheral velocity of the intermediate transfer belt or the peripheral velocity of the photosensitive drums is corrected. The velocity of the intermediate transfer belt is transiently varied in an image forming operation. Accordingly, a plurality of toner patch patterns including toner patches are formed on the intermediate transfer belt, and the difference in peripheral velocity between the intermediate transfer belt and the photosensitive drums is estimated based on a difference between the displacements in the toner patch patterns.

8 Claims, 20 Drawing Sheets

IMAGE FORMING APPARATUS

BACKGROUND OF THE INVENTION

1. Field of the Invention

The present invention relates to image forming apparatuses which form images on recoding media, such as printing paper, photosensitive paper, and electrostatic recording paper. More particularly, the present invention relates to an image forming apparatus in which toner images are transferred onto a rotary member, such as an intermediate transfer belt, from a plurality of image bearing members.

2. Description of the Related Art

Recently, there has been a demand for electrophotographic color image forming apparatuses, such as color printers and color copy machines, with high output image quality.

Factors which determine the output image quality include recording accuracy which typically affects the displacement of a print start position at which a process of printing an image on a recording medium, such as paper, is started, image expansion and contraction, etc., and color registration. The color registration is an index of accuracy with which toner images of different colors are superimposed, and affects the color of the output image. In particular, in an electrophotographic color image forming apparatus, when the environment changes or when the apparatus is used for a long term, a reduction in the recording accuracy and a variation in color due to color misregistration will occur due to variable factors of components included in the apparatus. As a result, the output image quality will be degraded.

In, for example, an image forming apparatus which uses an intermediate transfer belt as an endless belt, one of the causes of the above-mentioned variation is a variation in the velocity of the intermediate transfer belt.

Accordingly, a method described in, for example, Japanese Patent No. 2655603 is used. More specifically, toner patches of different colors are formed on the intermediate transfer belt, and the positions of the toner patches are detected by registration detection sensors. The timing at which the toner images of different colors are formed on the intermediate transfer belt is changed in accordance with the detection result, and thus the color misregistration can be reduced. Here, the toner patches are unfixed toner images used for detecting the color misregistration.

However, even if the color misregistration is corrected using the registration detection sensors according to the related art, the color misregistration generated when the toner images of the respective colors are transferred onto a recording medium cannot be completely eliminated in practice.

The main cause of this is that the peripheral velocity of the intermediate transfer belt in the process of detecting the positions of the toner patches on the belt with the registration detection sensors differs from the peripheral velocity of the belt in the actual image forming operation. The difference in the peripheral velocity of the intermediate transfer belt will be described below.

FIG. 11 is a diagram illustrating the state in which load is applied to an intermediate transfer belt unit in a tandem color image forming apparatus using a common intermediate transfer belt. Referring to FIG. 11, to improve the transfer efficiency, a peripheral velocity Vb of the intermediate transfer belt is generally set to be about 0.5% or less higher than a peripheral velocity Vd of photosensitive drums. In this case, when Tb is a torque necessary for moving only the belt and μF is a frictional force generated by the contact between the belt and the drums, a belt driving torque T can be calculated as follows:

$$T=Tb+\mu F\times 4 \quad (11)$$

In the above equation, μ is a coefficient of friction between the belt and the drums and F is a transfer pressure.

In contrast, referring to FIG. 12, if the drum peripheral velocity Vd is intentionally set to be higher than the belt peripheral velocity Vb, the belt driving torque T can be obtained as follows:

$$T=Tb-\mu F\times 4 \quad (12)$$

In this case, the belt driving torque T is reduced since the photosensitive drums rotate the belt.

Assuming that there are two kinds of coefficients of friction μ between the belt and the drums as described below, the torque T varies as in Equations (13) to (17) given below during the time period from when the belt in the stationary state is activated and to when the belt is stopped after the image forming operation. In this case, the state in which the load torque is applied to the belt changes as shown in FIGS. 13 to 20. Each of FIGS. 13 to 20 shows a structure including photosensitive drums 26, developing rollers 54, primary transfer rollers 52, and an intermediate transfer belt 30. With regard to the colors, Y, M, C, and Bk denote yellow, magenta, cyan, and black, respectively. The two kinds of coefficients of friction μ between the belt and the drums are a coefficient of friction μ1 applied when no toner is present between the belt and the drums and a coefficient of friction μ2 applied when toner is present between the belt and the drums.

$$T=Tb+\mu 1F\times 4 \quad \text{(13) (see FIG. 13)}$$

$$T=Tb+(\mu 1\times 3+\mu 2F) \quad \text{(14) (see FIG. 14)}$$

$$T=Tb+(\mu 1F\times 2+\mu 2F\times 2) \quad \text{(15) (see FIG. 15)}$$

$$T=Tb+(\mu 1F+\mu 2F\times 3) \quad \text{(16) (see FIG. 16)}$$

$$T=Tb+\mu 2F\times 4 \quad \text{(17) (see FIG. 17)}$$

With regard to the states shown in FIGS. 18 to 20, FIG. 18 corresponds to Equation (16), FIG. 19 to Equation (15), and FIG. 20 to Equation 14. Then, the state returns to that shown in FIG. 13, which corresponds to Equation (13).

Referring to FIG. 14, when the developing roller 54Y comes into contact with the photosensitive drum 26Y, the toner on the developing roller 54Y is supplied to the photosensitive drum and adheres thereto irrespective of a latent image formed thereon, and then the toner is conveyed to a nip section between the photosensitive drum and the intermediate transfer belt. Therefore, the presence or absence of the toner in the nip section between the photosensitive drum and the intermediate transfer belt is determined depending on whether the developing roller in the developing device is in a contact state or a non-contact state, and does not depend on the toner actually used to form an image in accordance with the latent image.

With regard to the relationship between the magnitudes of the above-described coefficients of friction μ1 and μ2, μ1>μ2 is generally satisfied. The load (torque) applied to the belt is reduced when the developing device is in the contact state and is increased when the developing device is in the separated state.

In the image forming apparatus according to the related art, the belt driving torque applied in the process of detecting the toner patches on the belt with the registration detection sensors can be calculated as in Equation (17) and is maintained constant. In addition, the peripheral velocity of the belt is also constant. This is obviously different from the state in which the torque varies in the image forming operation.

The belt is driven by a belt drive transmission system including a gear train. As defined by the Hooke's law, the belt drive transmission system is elastically deformed by an amount proportional to a stress generated by a load torque applied by the belt drive transmission system. Due to the elastic deformation, the transmission speed of the drive transmission system, that is, the belt peripheral velocity, varies.

When each of the states corresponding Equations (13) to (17) changes to the next state, the belt peripheral velocity also changes. For example, the belt peripheral velocity decreases when the load torque applied to the belt increases, and the belt peripheral velocity increases when the load torque applied to the belt decreases.

In the image forming apparatus according to the related art, the process of detecting the toner patches on the belt with the registration detection sensors is performed while the belt velocity does not vary, and the correction is performed on the basis of the thus-obtained detection result. However, in the actual image forming operation, the belt peripheral velocity varies when the load torque largely varies. When the belt peripheral velocity varies, the color misregistration (displacement of transfer position) easily occurs.

The variation in the belt velocity can be eliminated by the following three methods. The first method is to eliminate the elastic deformation by increasing the rigidity of the belt drive transmission system. The second method is to eliminate the variation in the coefficient of friction $\mu$ between the belt and the drums. The third method is to form images after the state corresponding to Equation (17) is obtained.

The first method will be explained. In general, the above-described elastic deformation can be suppressed by increasing the rigidity of the belt drive transmission system. The rigidity can be increased by, for example, changing the material of gears included in the drive transmission system from resin, such as polyacetal, to metal, such as brass. The inventors of the present invention experimentally confirmed that the velocity variation can be reduced by increasing the rigidity by using metal gears. However, in such a case, the rigidity of the metal gears is excessively high and vibration of the gears which mesh with each other occurs. Therefore, there is a problem that the images will be affected by the generated vibration. In addition, since the metal gears are formed by machining processes, high costs are incurred compared to resin gears which can be formed by injection molding.

Next, the second method will be explained. Theoretically, variation in the coefficient of friction $\mu$ can be eliminated if the coefficients of friction $\mu\mathbf{1}$ and $\mu\mathbf{2}$ are equal to each other. However, in practice, surface layers of the photosensitive drums are smooth and easily adhere to the belt. Therefore, a considerably large frictional force is generated. Although the frictional force can be reduced by forming slightly irregular surfaces on the photosensitive drums and reducing the contact areas thereof, there is a risk that the image quality will be degraded in such a case. Therefore, this method is not practical. In addition, variation in the frictional force is due not only to the presence or absence of the toner but also to the attractive force caused by the transfer bias, and cannot be eliminated.

Next, the third method will be explained. The third method can be technically realized by starting and stopping a charging step, a developing step, and a transfer step, which are performed by image-forming process units and which cause the load variation, in a period other than the period in which visible images are transferred onto the intermediate transfer belt from the photosensitive drums. In such a case, high-quality images in which color misregistration is suppressed can be obtained. However, since the charging step, the developing step, and the transfer step performed by the above-mentioned units are started and stopped in a period other than the period in which the visible images are transferred onto the intermediate transfer belt from the photosensitive drums, the time required for the charging step, the developing step, etc., is increased and the yield of the apparatus is reduced. In addition, there is also a problem that the lives of the above-mentioned units will be reduced. This cannot be ignored, in particular, when intermittent recording is performed. In such a case, a user must frequently replace the above-mentioned units and high running costs are incurred.

SUMMARY OF THE INVENTION

The present invention provides an image forming apparatus in which a transient velocity variation of a belt, which is a rotary member, can be reduced in an image forming operation and color misregistration can be reduced without reducing the yield of the image forming apparatus.

According to an aspect of the present invention, an image forming apparatus includes a rotary member onto which toner images formed on a plurality of image bearing members are transferred; developing devices capable of coming into contact with and separating from the respective image bearing members, the developing devices forming the toner images on the respective image bearing members; a patch detector configured to detect positions of toner patches, the toner patches being transferred onto the rotary member from the image bearing members and forming a toner patch pattern; and a control device configured to control a peripheral velocity of the rotary member or a peripheral velocity of the image bearing members based on a detection result obtained by the patch detector. The toner patch pattern on the rotary member includes a first toner patch transferred onto the rotary member from one of the image bearing members while all of the developing devices are in contact with the respective image bearing members and a second toner patch transferred onto the rotary member from another one of the image bearing members while one or more of the developing devices are in contact with or separated from the respective image bearing members. The patch detector detects positions of the first and second toner patches included in the toner patch pattern. A displacement between the first toner patch and the second toner patch in a rotational direction of the rotary member is calculated based on the detection result obtained by the patch detector. The peripheral velocity of the rotary member or the peripheral velocity of the image bearing members is changed based on the calculated displacement.

According to another aspect of the present invention, an image forming apparatus includes a rotary member onto which toner images formed on a plurality of image bearing members are transferred; developing devices capable of coming into contact with and separating from the respective image bearing members, the developing devices forming the toner images on the respective image bearing members; a patch detector configured to detect positions of toner patches, the toner patches being transferred onto the rotary member from the image bearing members and forming a first toner patch pattern and a second toner patch pattern; and a control device configured to control a peripheral velocity of the rotary member or a peripheral velocity of the image bearing members based on a detection result obtained by the patch detector. The first toner patch pattern includes a plurality of first toner patches transferred onto the rotary member from the image bearing members while all of the developing devices are in contact with the respective image bearing members, the patch detector detects positions of the first toner patches included in the first toner patch pattern, and a first displacement between the first toner patches in a rotational direction of the rotary member is calculated based on the detection result obtained by the patch detector. The second toner patch pattern includes a first toner patch transferred onto the rotary member from one of the image bearing members while all of the developing devices are in contact with the respective image bearing members and a second toner patch transferred onto the rotary member from another one of the image bearing members while one or more of the developing devices are in contact with or separated from the respective image bearing members, the patch detector detects positions of the first and second toner patches, and a second displacement between the first and second toner patches in the rotational direction of the rotary member is calculated based on the detection result obtained by the patch detector. The peripheral velocity of the rotary member or the peripheral velocity of the image bearing members is changed based on a difference between the second displacement and the first displacement.

Further features of the present invention will become apparent from the following description of exemplary embodiments with reference to the attached drawings.

DESCRIPTION OF THE EMBODIMENTS

Embodiments of the present invention will be described in detail below with reference to the accompanying drawings. However, the dimensions, materials, shapes, relative arrangements, etc., of the components described in the following embodiments may be suitably changed in accordance with the structure and various conditions of the apparatus to which the present invention is applied. Therefore, unless specifically stated otherwise, the scope of the present invention is not limited by the embodiments described below.

Figure 1:
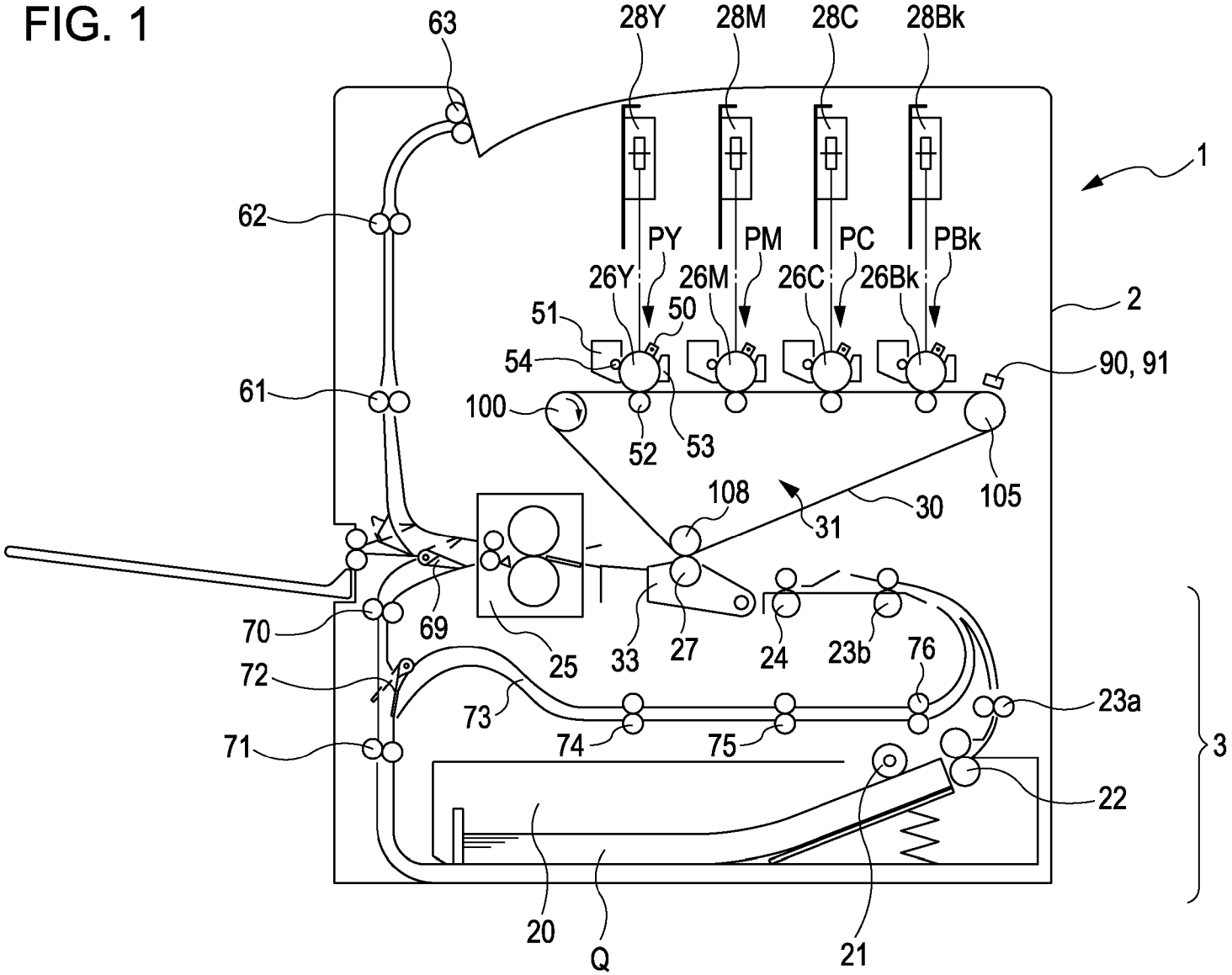
FIG. 1 is a sectional view illustrating the schematic structure of a four-drum full-color image forming apparatus including an intermediate transfer belt.

An image forming apparatus according to a first embodiment of the present invention will now be described. In the first embodiment, a four-drum full-color image forming apparatus including an intermediate transfer belt, which serves as a rotary member, is explained as an example of an electrophotographic image forming apparatus. FIG. 1 is a schematic sectional view illustrating the structure of a four-drum full-color image forming apparatus including an intermediate transfer belt.

Overall Structure of Image Forming Apparatus

As shown in FIG. 1, in the four-drum full-color image forming apparatus 1, four process cartridges P, that is, yellow, magenta, cyan, and black process cartridges PY, PM, PC, and PBk for the respective colors are detachably attached to an image-forming-apparatus main body (hereinafter called an apparatus main body) 2. The apparatus main body 2 includes an intermediate transfer belt unit 31 including an intermediate transfer belt 30, which serves as a rotary member, and a fixing device 25.

The process cartridges P are provided with memory tags (not shown), and communicate with the apparatus main body 2 so that the remaining lives of the process cartridges P and necessity for replacement thereof can be determined.

In addition, the process cartridges P are respectively provided with photosensitive drums 26Y, 26M, 26C, and 26Bk which serve as image bearing members. In each of the process cartridges P, a primary charging device 50 which serves as a charging unit, a developing device 51, and a cleaner 53 which serves as a cleaning unit are arranged along the periphery of the corresponding photosensitive drum and are formed integrally with the photosensitive drum. The process cartridges P are arranged next to each other along the intermediate transfer belt 30.

In each process cartridge P, the primary charging device 50 is arranged on the peripheral surface of the photosensitive drum 26 and uniformly charges the surface of the photosensitive drum. The developing device 51 develops an electrostatic latent image for the corresponding color on the surface of the photosensitive drum with toner of the corresponding color (yellow, magenta, cyan, or black). The electrostatic latent image is formed by irradiating the surface of the photosensitive drum with light emitted from a corresponding one of laser emitting devices (exposure units) 28Y, 28M, 28C, and 28Bk. The developing device 51 includes a developing roller 54. When the process of developing the electrostatic image on the surface of the photosensitive drum is not being performed, the developing roller 54 in the developing device 51 is separated from the photosensitive drum 26 and the rotation thereof is stopped. Thus, deterioration of the developer can be suppressed. In other words, each developing device 51 is structured such that the developing device 51 can be brought into contact with and separated from the corresponding photosensitive drum 26. The cleaner 53 removes the toner which remains on the surface of the photosensitive drum after the toner image is transferred.

In addition, primary transfer rollers 52, which form primary transfer sections together with the respective photosensitive drums 26, are arranged so as to face the photosensitive drums 26 and hold the intermediate transfer belt 30 therebetween.

The intermediate transfer belt unit 31 includes the intermediate transfer belt 30 and three rollers. The three rollers include a drive roller 100 which stretches the intermediate transfer belt 30, a tension roller 105, and a secondary transfer roller 108. The drive roller 100 is rotated by a belt drive motor (not shown), and the intermediate transfer belt 30 is rotated and conveyed accordingly. In other words, the intermediate transfer belt 30 is a rotary member which is rotated by the drive roller 100.

The tension roller 105 is structured such that the tension roller 105 can be moved in the horizontal direction in FIG. 1 in accordance with the length of the intermediate transfer belt 30.

In addition, two registration detection sensors 90 for detecting toner patches on the intermediate transfer belt 30 are arranged near the ends of the tension roller 105 in the longitudinal direction thereof. Here, the longitudinal direction refers to the axial direction of the roller, that is, a belt width direction which is perpendicular to a belt conveying direction in which the belt is conveyed.

In addition, a secondary transfer roller 27, which forms a secondary transfer section together with the secondary transfer roller 108, is arranged so as to face the secondary transfer roller 108 and hold the intermediate transfer belt 30 therebetween. The secondary transfer roller 27 is held by a transfer conveying unit 33.

In addition, a feeding unit 3 for feeding a recording medium Q, such as a sheet of paper, to the secondary transfer section is disposed in a lower section of the apparatus main body 2. The feeding unit 3 includes a cassette 20 which stores a plurality of recording media Q, a feed roller 21, a pair of retard rollers 22 which serve to prevent double feeding, a pair of transfer rollers 23*a* and 23*b*, and a pair of registration rollers 24.

Pairs of ejection rollers 61, 62, and 63 are disposed along a conveying path disposed downstream of the fixing device 25.

The color image forming apparatus 1 is capable of performing a duplex printing operation. In the duplex printing operation, a recording medium Q on which an image is formed on one side thereof is ejected from the fixing device 25. Then, a switching member 69 is switched so that the recording medium Q is conveyed to pairs of reverse rollers 70 and 71. After the trailing end of the recording medium Q passes through a switching member 72, the switching member 72 is switched and the reverse rollers 71 are rotated in the reverse direction so that the recording medium Q is guided to a duplex printing path 73.

Then, pairs of duplex-printing conveying rollers 74, 75, and 76 are rotated to feed the recording medium Q again. Thus, an image can be formed on the other side of the recording medium Q.

Figure 2:
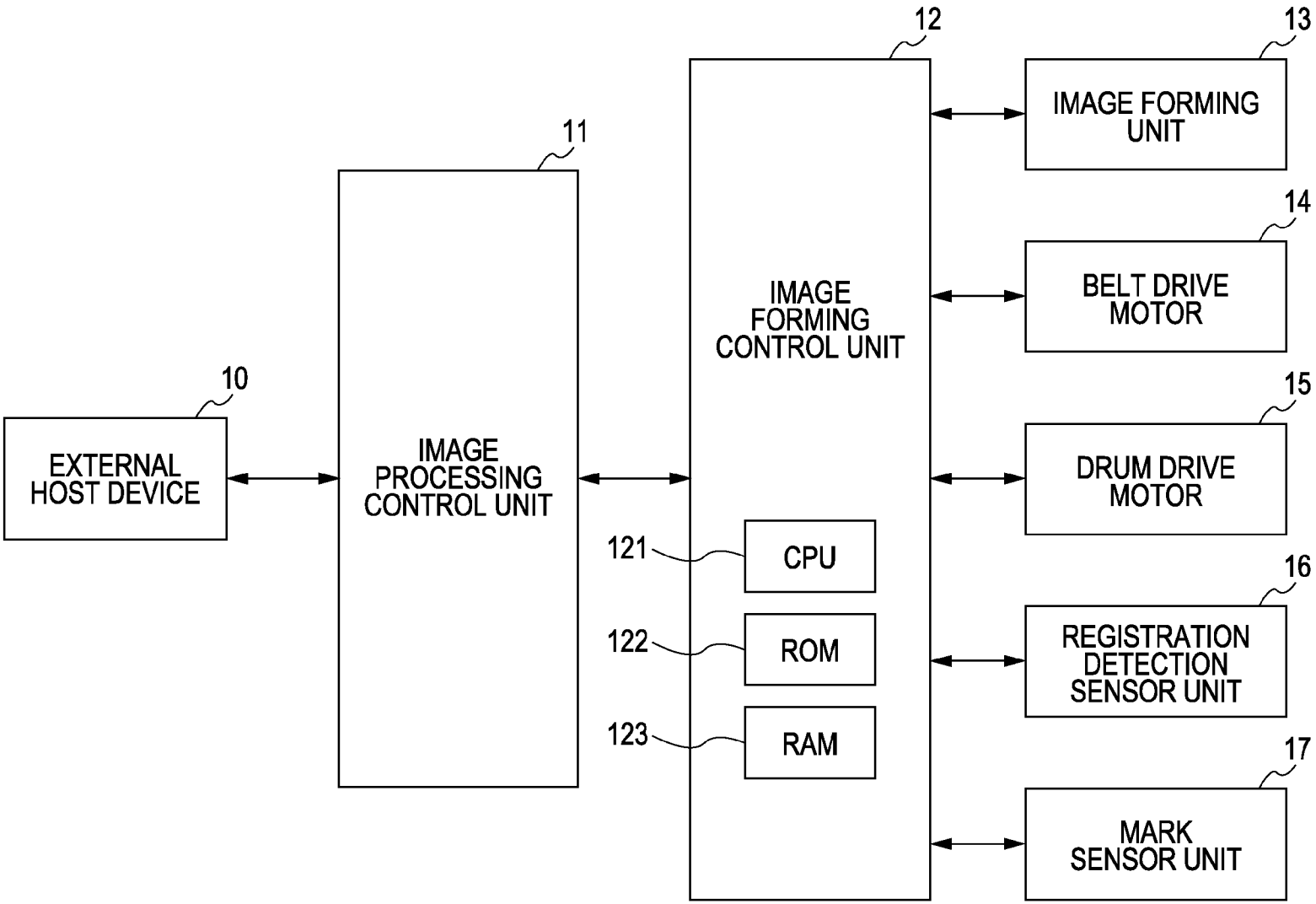
FIG. 2 is a block diagram illustrating the structure of the image forming apparatus.

Next, the structure of a control system of the image forming apparatus will be described with reference to FIG. 2. FIG. 2 is a block diagram illustrating the structure of the control system of the image forming apparatus.

The apparatus main body 2 shown in FIG. 1 receives an RGB image signal from an external host device 10, such as a personal computer, which is connected to the apparatus main body 2 such that data can be transmitted therebetween, or from a document reading unit (not shown) included in the apparatus main body 2.

An image processing control unit 11 converts the received RGB signal into a CMYK signal, and performs processes for correcting gradation and density. Then, the image processing control unit 11 generates an exposure signal for the laser emitting devices 28. An image forming control unit 12 (control device) controls the overall image forming operation, which will be described below. In addition, the image forming control unit 12 also controls the apparatus main body 2 in a correction process performed in the image forming operation using the registration detection sensors 90, which function as patch detectors, and a mark sensor 91, which functions as a mark detector.

The image forming control unit 12 includes a CPU 121 which controls the processes performed by the image forming control unit 12, a ROM 122 which stores programs to be executed by the CPU 121, and a RAM 123 which stores various data used in the control processes performed by the CPU 121.

A plurality of image forming units 13 (four in this embodiment) are arranged along a rotational direction of the intermediate transfer belt, and the image forming units 13 include the respective photosensitive drums 26, the charging devices for charging the drums, the developing devices, the cleaning members, and the exposure devices, as shown in FIG. 1.

A belt drive motor 14 is a driving member which receives an instruction from the image forming control unit 12 and rotates the intermediate transfer belt 30 at a predetermined velocity.

A drum drive motor 15 is a driving member which receives an instruction from the image forming control unit 12 and rotates all of the photosensitive drums 26 at a predetermined velocity.

A registration detection sensor unit 16 detects the toner patches on the intermediate transfer belt 30 with the registration detection sensors 90. The toner patches will be described below.

A mark sensor unit 17 detects a position display mark on the intermediate transfer belt 30 with the mark sensor 91.

Image Forming Operation

The image forming operation performed by the four-drum full-color image forming apparatus 1 structured as described above will be described with reference to FIG. 1. The image forming apparatus 1 is capable of forming an image with toners of a plurality of colors (four colors in this embodiment) on a recording medium.

When the image forming operation is started, the recording media Q stored in the cassette 20 are fed by the feed roller 21 and are separated from each other by the retard rollers 22. Then, each recording medium Q is conveyed to the registration rollers 24 through the transfer rollers 23*a* and 23*b*. At this time, rotation of the registration rollers 24 is stopped and the recording medium Q is brought into contact with the nip portion between the registration rollers 24 so that oblique feeding of the recording medium Q can be prevented.

While the above-described process of conveying the recording medium Q is being performed, in, for example, the yellow process cartridge PY, the surface of the photosensitive drum 26Y is uniformly charged by the primary charging device 50 and is then irradiated with light emitted by the laser emitting device 28Y in accordance with an image. Accordingly, an electrostatic latent image corresponding to a yellow image component of the image signal is formed on the surface of the photosensitive drum 26Y.

Next, the developing roller 54 in the corresponding developing device 51 is brought into contact with the photosensitive drum 26Y while the developing roller 54 is being rotated, and the above-described electrostatic latent image is developed with yellow toner that is negatively charged by the developing device 51. Thus, the electrostatic latent image is visualized as a yellow toner image. Then, the thus-obtained yellow toner image is transferred onto the intermediate transfer belt 30 by the corresponding primary transfer roller 52 to which a primary transfer bias is applied.

After the toner image is transferred, the cleaner 53 removes the toner which remains on the surface of the photosensitive drum 26Y.

The above-described toner-image forming operation is also performed in the other process cartridges PM, PC, and PBk at a predetermined timing. The toner images of the respective colors formed on the respective photosensitive drums 26 are successively transferred onto the intermediate transfer belt 30 at the respective primary transfer sections such that the toner images are superimposed on each other.

When the developing process is finished, to prevent the degradation of the developing agent, the developing rollers 54 are separated from the respective photosensitive drums and the rotations thereof are stopped even if the primary transfer process is still performed in the downstream process cartridges.

Next, the toner images of the four colors, which are superimposed on each other on the intermediate transfer belt 30, are moved to the secondary transfer section as the intermediate transfer belt 30 rotates in the direction shown by the arrow.

In addition, the recording medium Q, the inclination of which is adjusted by the registration rollers 24, is conveyed to the secondary transfer section in synchronization with the images formed on the intermediate transfer belt 30.

Then, the secondary transfer roller 27, which is pressed against the intermediate transfer belt 30 with the recording medium Q therebetween, transfers the toner images of the four colors on the intermediate transfer belt 30 onto the recording medium Q. The recording medium Q on which the toner images are transferred as described above is conveyed to the fixing device 25, and the fixing device 25 applies heat and pressure to fix the toner images. Then, the recording medium Q is ejected through the pairs of ejection rollers 61, 62, and 63, and is placed on the top surface of the apparatus main body 2.

After the secondary transfer process, a belt cleaner (not shown) disposed near the drive roller 100 removes the toner which remain on the surface of the intermediate transfer belt 30. In the present embodiment, the toner which remains on the surface of the intermediate transfer belt 30 after the secondary transfer process is removed by the belt cleaner, and is thereby prevented from being conveyed to the primary transfer sections again.

Next, variation in a belt driving torque T applied to the intermediate transfer belt in the case where the peripheral velocity Vd of the photosensitive drums is equal to the peripheral velocity Vb of the intermediate transfer belt will be explained.

Figure 9:
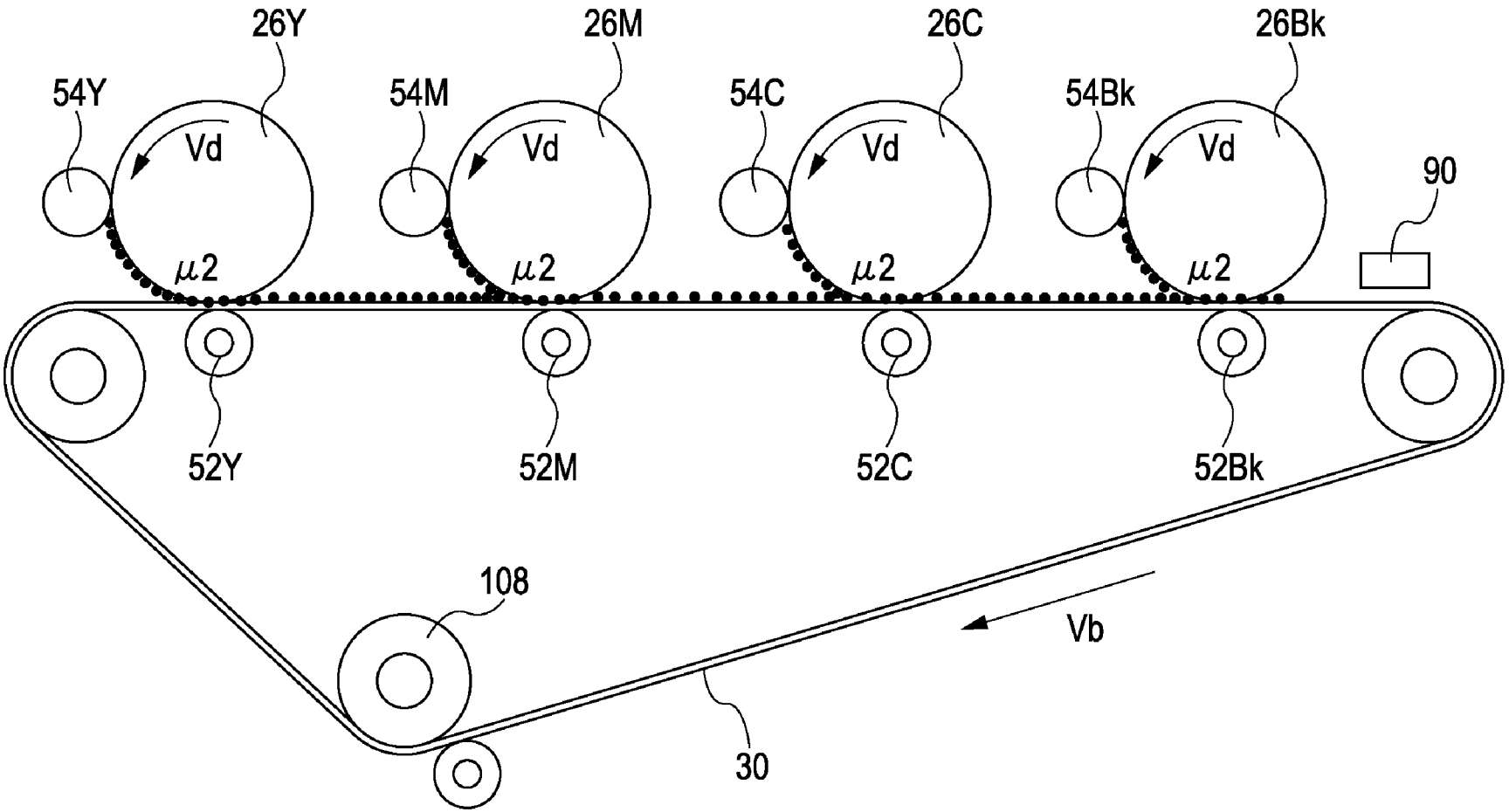
FIG. 9 is a diagram illustrating the state in which load torque is applied to the belt.

FIG. 9 is a diagram illustrating the state in which the load is applied in the case where the peripheral velocity Vd of the photosensitive drums is equal to the peripheral velocity Vb of the intermediate transfer belt. In this case, the driving torque T applied the intermediate transfer belt can be expressed as T=Tb. Since the drum peripheral velocity Vd is equal to the belt peripheral velocity Vb, no slip occurs. Therefore, the belt driving torque T is equal to the torque Tb necessary for moving only the belt and is not increased or reduced by the frictional force.

The relationship between the difference between the drum peripheral velocity and the belt peripheral velocity and the belt driving torque will be described in detail with reference to the result of measurement and verification performed using an actual image forming apparatus.

Figure 3:
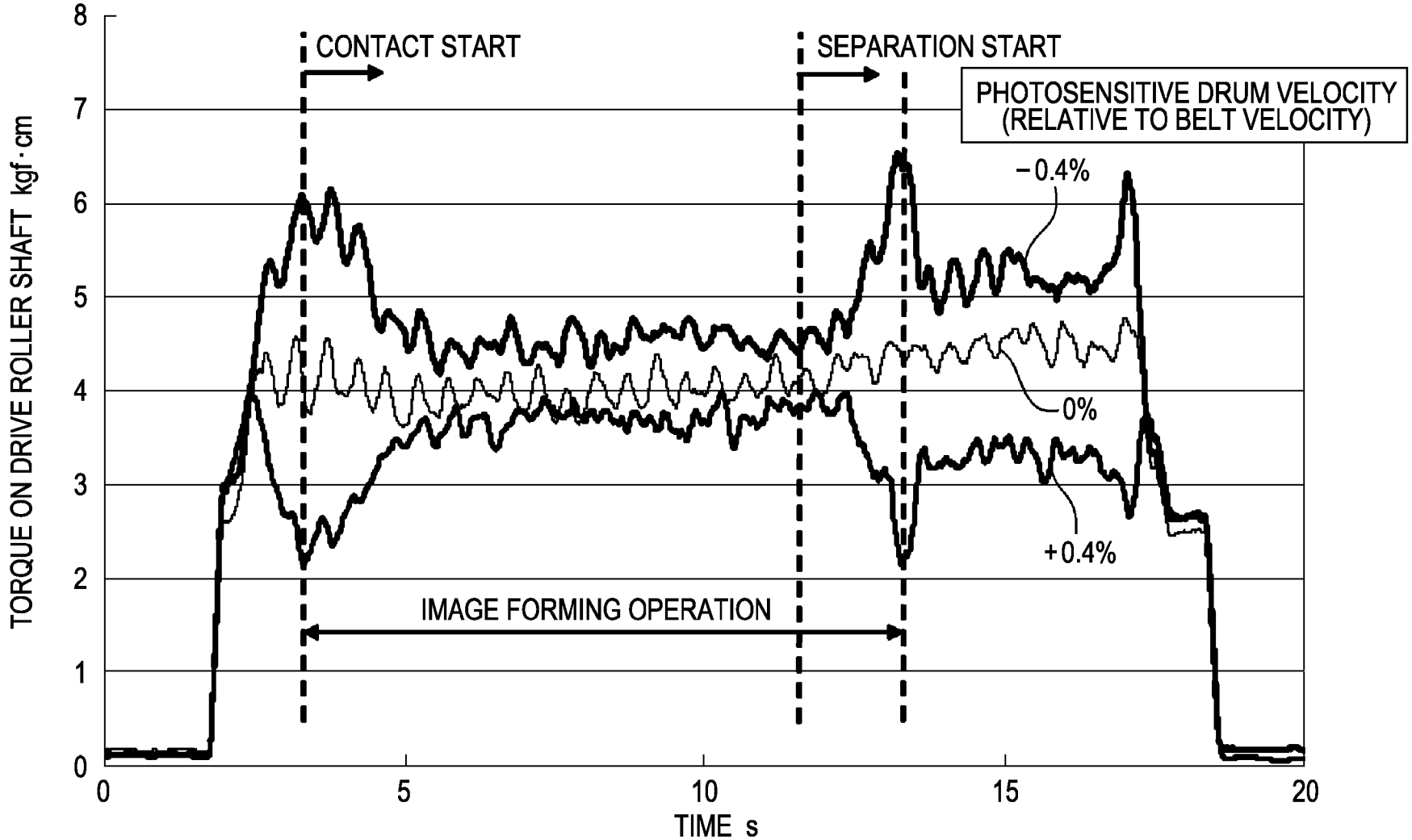
FIG. 3 is a graph showing the variation in torque applied by a drive roller for driving the intermediate transfer belt in an image forming operation.

FIG. 3 shows the result of measurement of variation in the rotational torque applied by the drive roller 100 in the process of successively printing images on three A3-size sheets using the image forming apparatus having the above-described structure.

In the measurement, the steady rotational velocity of the photosensitive drums 26 was changed to obtain the measurement result for both of the case in which the intermediate transfer belt 30 and the photosensitive drums 26 have different peripheral velocities and the case in which the intermediate transfer belt 30 and the photosensitive drums 26 have substantially the same peripheral velocity.

As is clear from FIG. 3, when the intermediate transfer belt 30 and the photosensitive drums 26 have different peripheral velocities, transient torque variation (load variation) occurs in the image forming operation. More specifically, the torque variation starts at a developing-device contact start time at which the developing roller 54 in the developing device 51 for yellow is brought into contact with the photosensitive drum 26Y while the developing roller 54 is being rotated. Then, the torque variation is reduced after all of the developing rollers 54 at the downstream positions are brought into contact with the respective photosensitive drums 26. Then, the torque variation starts again at a developing-device separation start time at which the primary transfer process for the yellow toner is finished at the upstream position and the developing roller 54 for yellow is separated from the photosensitive drum 26Y.

In the case where the photosensitive drum velocity is −0.4% relative to the intermediate transfer belt velocity, the driving torque applied to the intermediate transfer belt decrease when the process of bringing the developing devices into contact with the respective photosensitive drums is started. In the case where the photosensitive drum velocity is lower than the intermediate transfer belt velocity, when the toners of respective colors reach the corresponding primary transfer sections after the developing devices are brought into contact with the respective photosensitive drums, the frictional force between the belt and the drums decreases. Therefore, the reactive force applied to the belt by the drums, which serves as the load on the belt, is reduced.

Then, after the primary transfer process for the yellow toner performed at the upstream position is finished at the end of the image forming operation, the developing devices are successively separated from the respective photosensitive drums and the supply of toner to the primary transfer sections is stopped. Therefore, the drums serve as a drive load on the belt again and the belt driving torque starts to increase.

Figure 4:
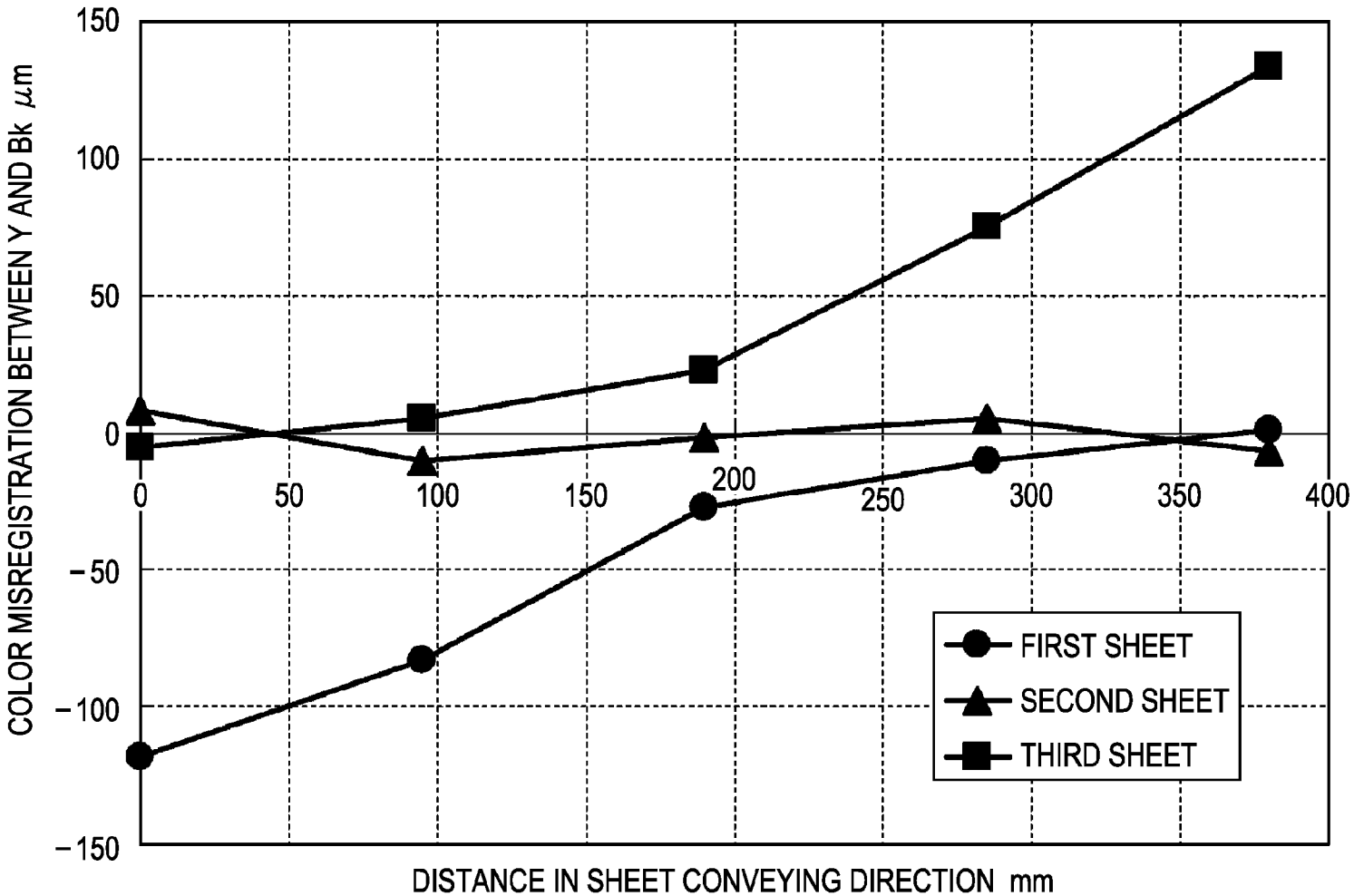
FIG. 4 is a graph showing the variation of color misregistration in output images.

Thus, images were printed on three A3-size sheets, which serve as recording media, while the difference in peripheral velocity is set such that the photosensitive drum velocity is lower than the intermediate transfer belt velocity. FIG. 4 shows the measurement result of color misregistration between yellow and black, that is, a positional displacement of the yellow image with respect to the black image, in the above-described case.

The vertical axis shows the displacement of the yellow image with respect to the black image, and the displacement with a positive sign shows the case in which the yellow image is shifted in a direction toward the trailing end of the A3-size sheet (downstream in the rotational direction of the belt). Here, the color misregistration between black and yellow is considered because the color misregistration occurs most significantly between yellow and black, which are respectively the first and last colors in the order of the transfer process, due to the reasons described below.

Referring to the measurement result for the first sheet in FIG. 4, a front half of the sheet, which corresponds to a distance range of 0 mm to 200 mm along the conveying direction of the recording medium, has the color misregistration. In addition, a rear half of the third sheet, which corresponds to a distance range of 200 mm or more along the conveying direction of the recording medium, has the color misregistration in a direction opposite to that in the front half of the first sheet.

The cause of the color misregistration in the first sheet relates to the fact that the belt driving torque is reduced after the process of bringing the developing devices into contact with the photosensitive drums is started, as shown in FIG. 3. Since the belt driving torque is reduced, the belt velocity is gradually increased in the primary transfer process for the yellow toner, which is the first color to be subjected to the primary transfer process. The cause of the color misregistration in the third sheet relates to the fact that the belt driving torque is increased after the process of separating the developing devices from the photosensitive drums is started, as shown in FIG. 3. Since the belt driving torque is increased, the belt peripheral velocity is gradually reduced in the primary transfer process for the black toner, which is the last color to be subjected to the primary transfer process.

The second sheet, for which the primary transfer process is performed while the torque does not vary, has substantially no color misregistration. Although not described herein, color misregistration regarding magenta and cyan also occurs. However, the color misregistration regarding magenta and cyan is not as significant as the color misregistration between yellow and black.

If the images are successively formed on three A3-size sheets while the difference in peripheral velocity is set such that the photosensitive drum velocity is lower than the intermediate transfer belt velocity, the result similar to that shown in FIG. 4 except the negative and positive signs are opposite to each other will be obtained.

In addition, it has been confirmed that the torque variation shown in FIG. 3 becomes more significant as the difference in peripheral velocity between the belt and the drums increases. The reason why the velocity of the belt varies in response to the torque variation is because the rigidity of the belt drive transmission system is insufficient.

Accordingly, in the present embodiment, a method for reducing the difference in the peripheral velocity between the belt and the drums, which causes the torque variation, is provided.

However, if, for example, the difference in the peripheral velocity between the belt and the drums is reduced by setting severe manufacturing tolerances for the components which affect the peripheral velocities of the belt and the drums, manufacturing costs will be increased. Therefore, according to the present embodiment, the color misregistration shown in FIG. 4 is detected, and the difference in peripheral velocity between the belt and the drums is estimated on the basis of the detection result. Then, the peripheral velocity of the drums is corrected in accordance with the estimated velocity difference to prevent the generation of color misregistration.

The above-described method will now be explained in detail.

To reduce to the difference in peripheral velocity between the belt and the drums, the peripheral velocity of the belt may be corrected in stead of correcting the peripheral velocity of the drums. The method of reducing the difference in peripheral velocity by correcting the peripheral velocity of the belt will be described below in the second embodiment.

Figure 5:
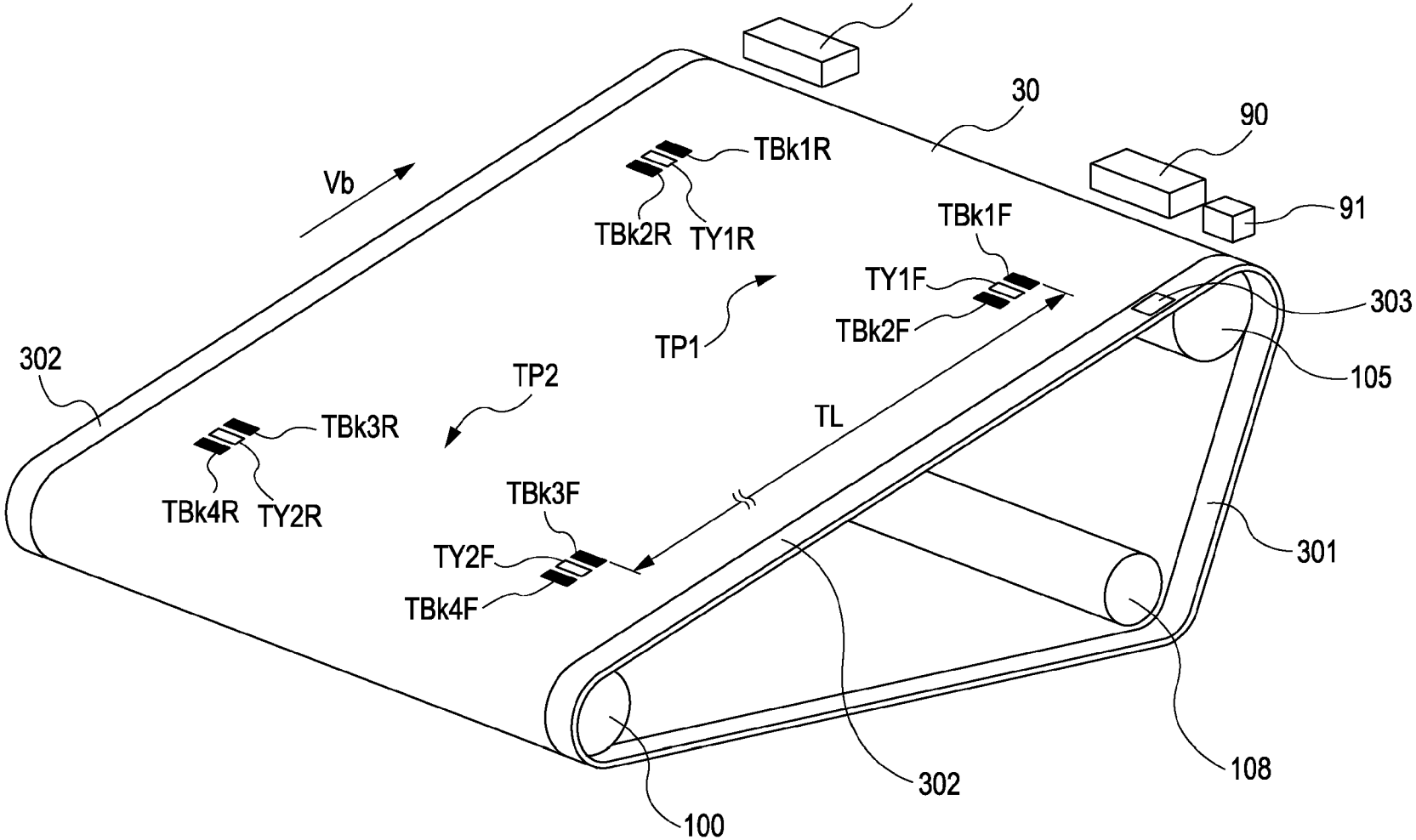
FIG. 5 is a perspective view of the intermediate transfer belt unit.

FIG. 5 is a perspective view illustrating the structure of the intermediate transfer belt unit 31. The intermediate transfer belt 30, which functions as a rotary member, is rotated at a peripheral velocity of Vb [mm/s] in the direction shown by the arrow. The design value of Vb is Vb=190.

According to the present embodiment, restraining ribs 301 which prevent the intermediate transfer belt 30 from meandering are provided on the inner surface of the intermediate transfer belt 30 along the edges thereof. The restraining ribs 301 are engaged with restraining flanges (not shown) provided at either end of the tension roller 105, and thereby the intermediate transfer belt 30 is prevented from meandering. Belt-reinforcing tape members 302 are provided on the outer surface of the intermediate transfer belt 30 so as to extend over the entire circumference along the edges thereof. The belt-reinforcing tape members 302 serve to prevent the intermediate transfer belt 30 from being damaged. It is not necessary that the restraining ribs 301 and the belt-reinforcing tape members 302 be provided along both edges of the intermediate transfer belt 30 as long as they are provided at the same edge of the intermediate transfer belt 30.

The registration detection sensors 90 are reflective optical sensors which detect unfixed toner patches formed on the intermediate transfer belt 30. In the present embodiment, one registration detection sensor 90 is disposed near each of the longitudinal ends of the tension roller 105.

The registration detection sensors 90 are positioned such that the registration detection sensors 90 can detect the toner patches in the state in which the intermediate transfer belt 30 is stretched around the tension roller 105, and are supported such that the registration detection sensors 90 can move in accordance with the movement of the shaft of the tension roller 105.

Next, the principle of the drum velocity correction using the registration detection sensors 90 will be described.

Formation of First Toner Patch Pattern

Figure 10:
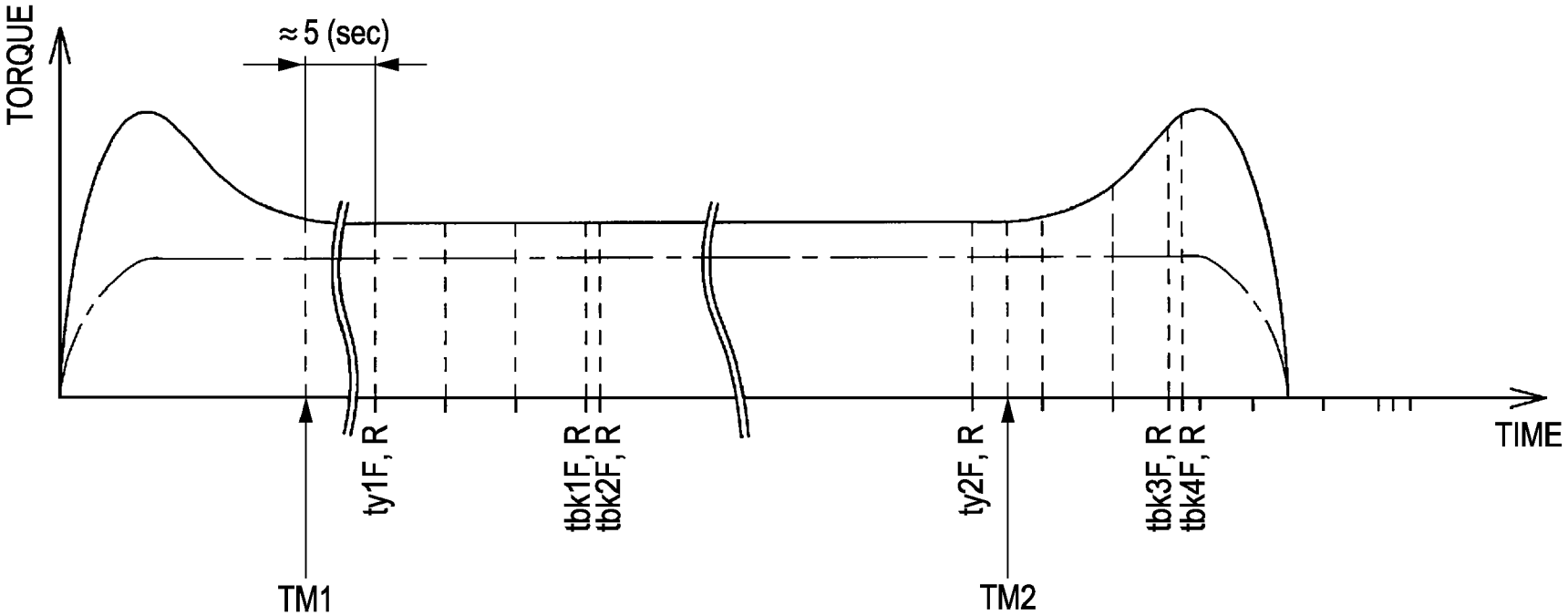
FIG. 10 is a graph showing the relationship between the timing at which toner patches are transferred and the load torque curve showing the load torque applied to the belt.
Figure 11:
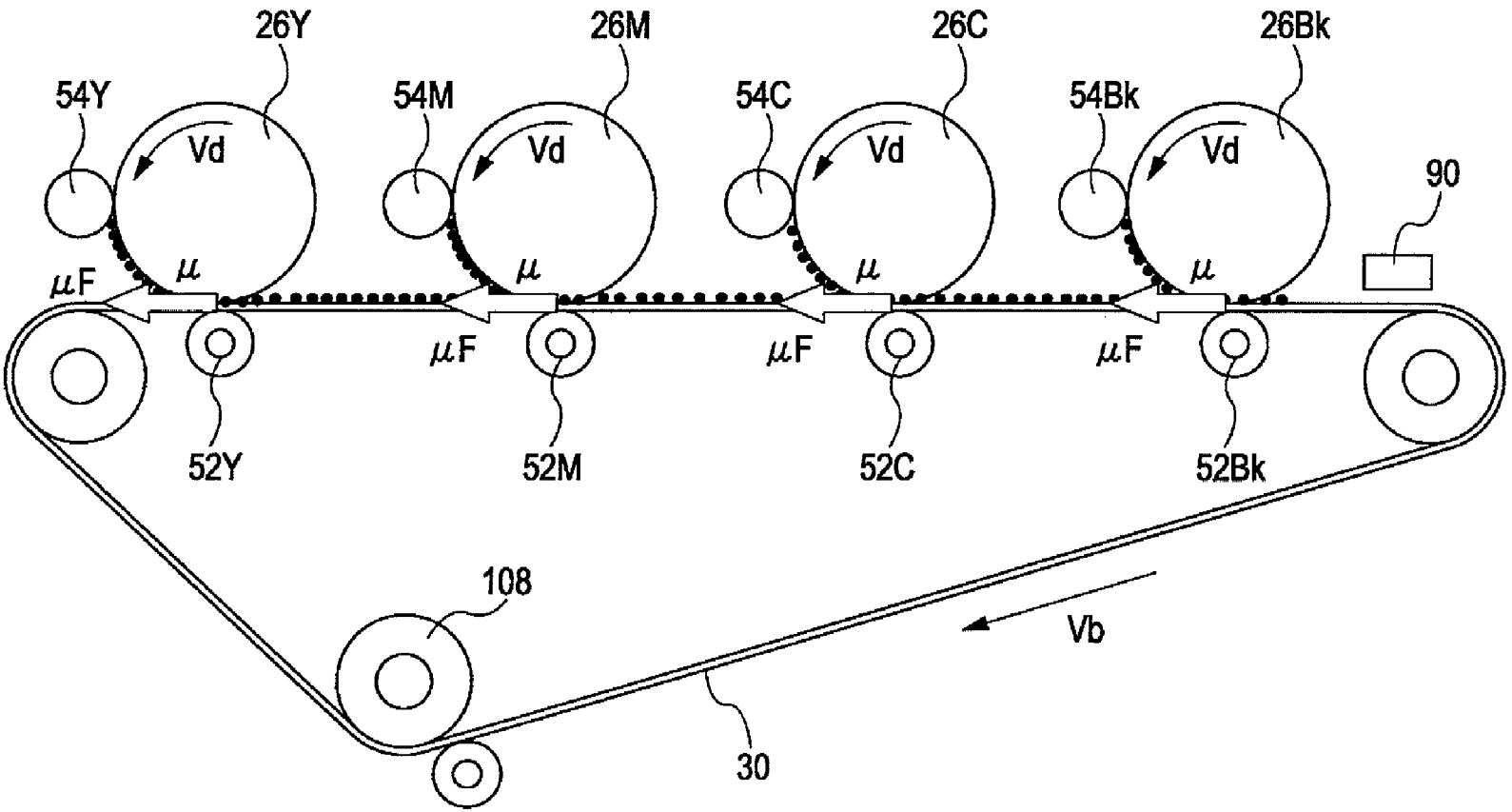
FIG. 11 (PRIOR ART)
FIG. 11 is a diagram illustrating the state in which load torque is applied to the belt.
Figure 12:
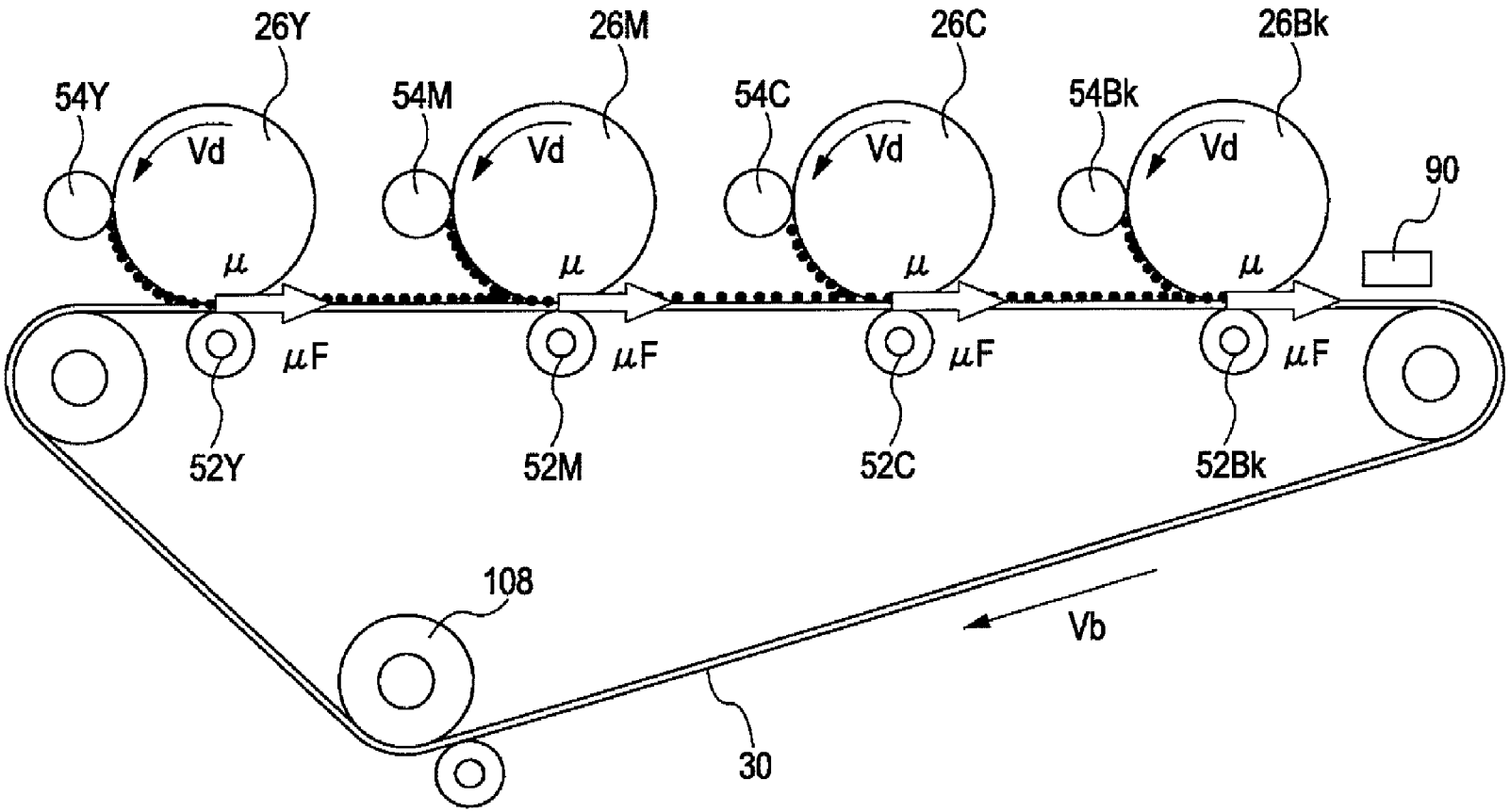
FIG. 12 (PRIOR ART)
FIG. 12 is a diagram illustrating the state in which load torque is applied to the belt.
Figure 13:
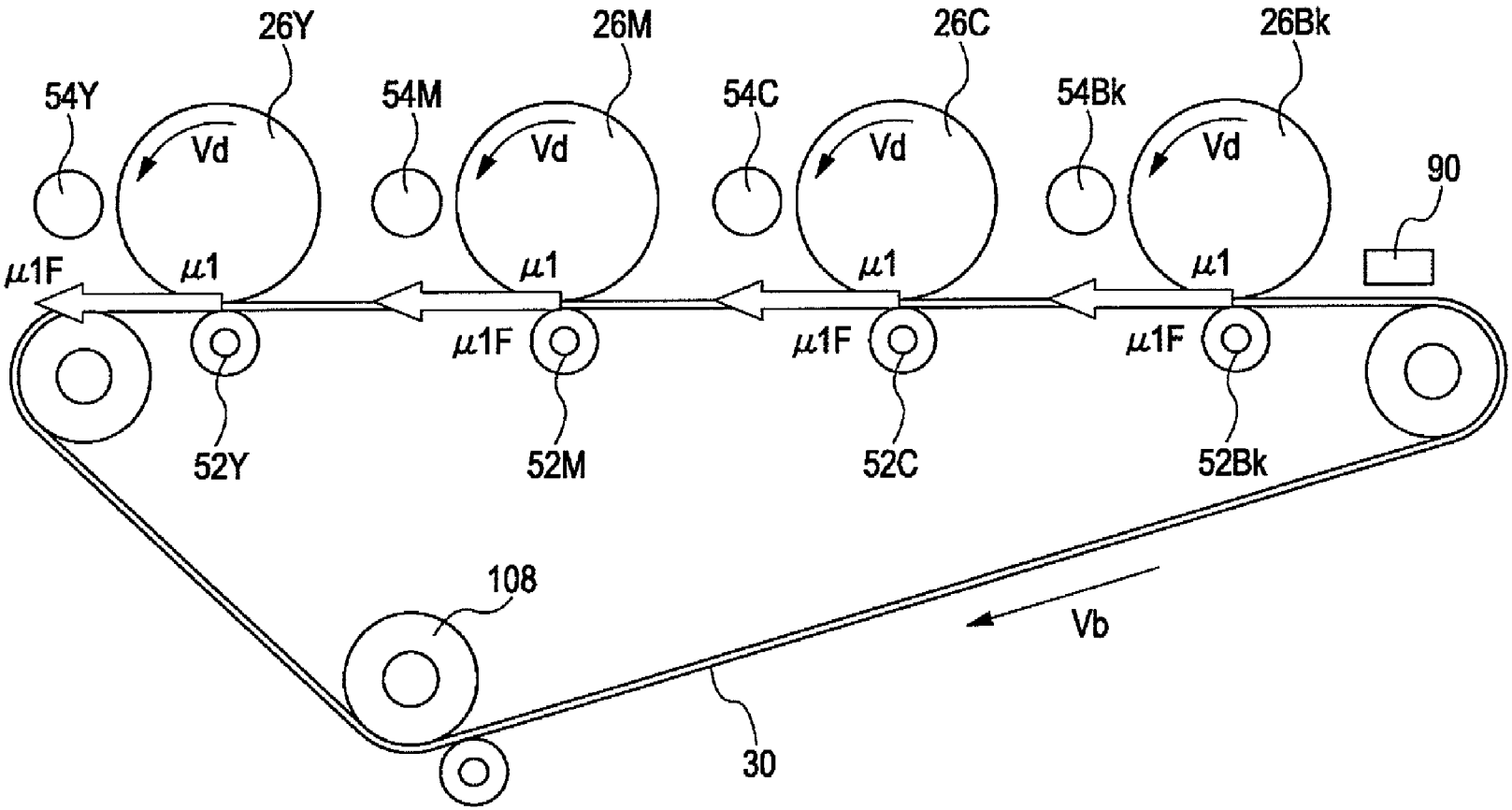
FIG. 13 (PRIOR ART)
FIG. 13 is a diagram illustrating the state in which load torque is applied to the belt.
Figure 14:
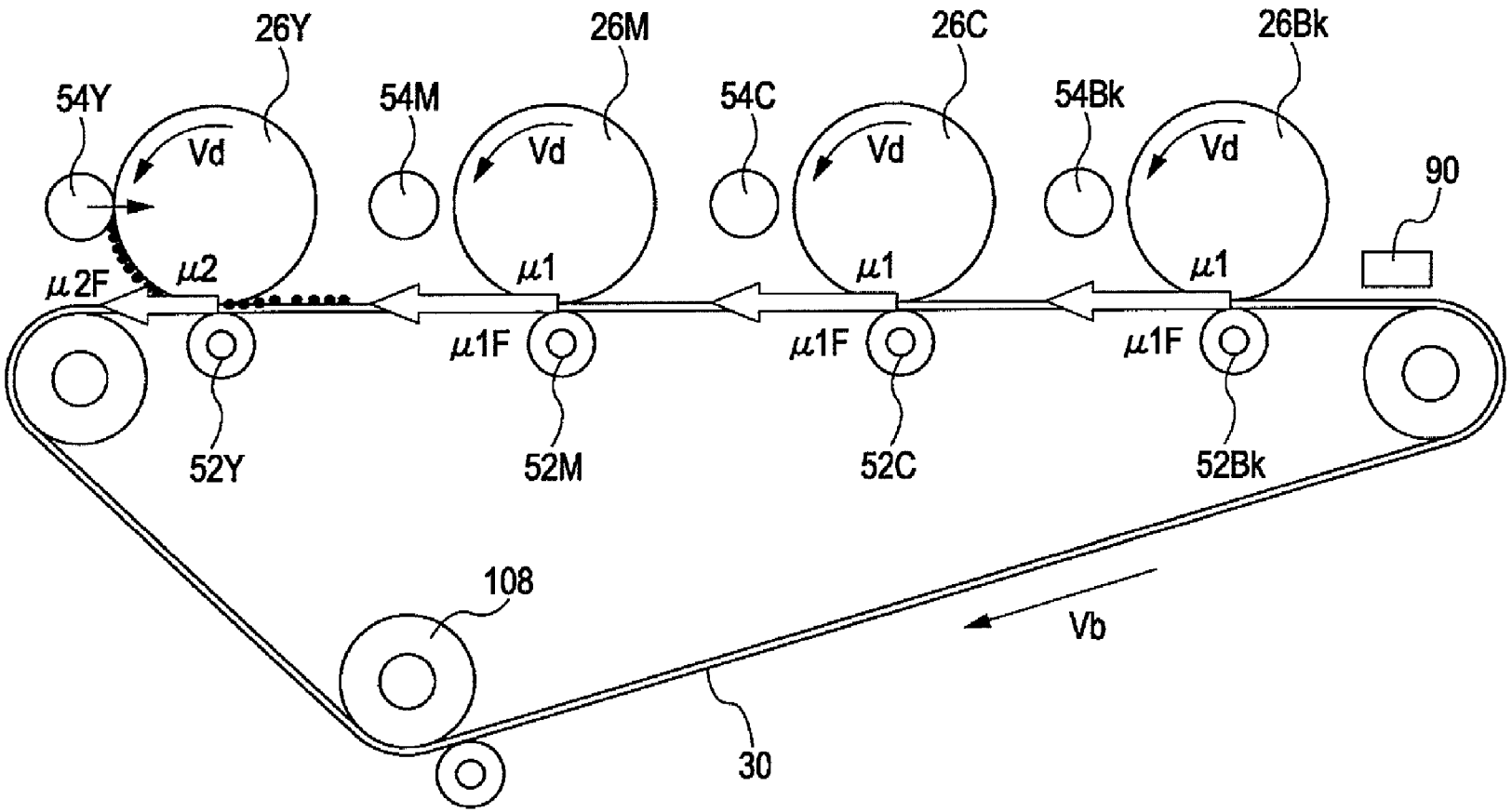
FIG. 14 (PRIOR ART)
FIG. 14 is a diagram illustrating the state in which load torque is applied to the belt.
Figure 15:
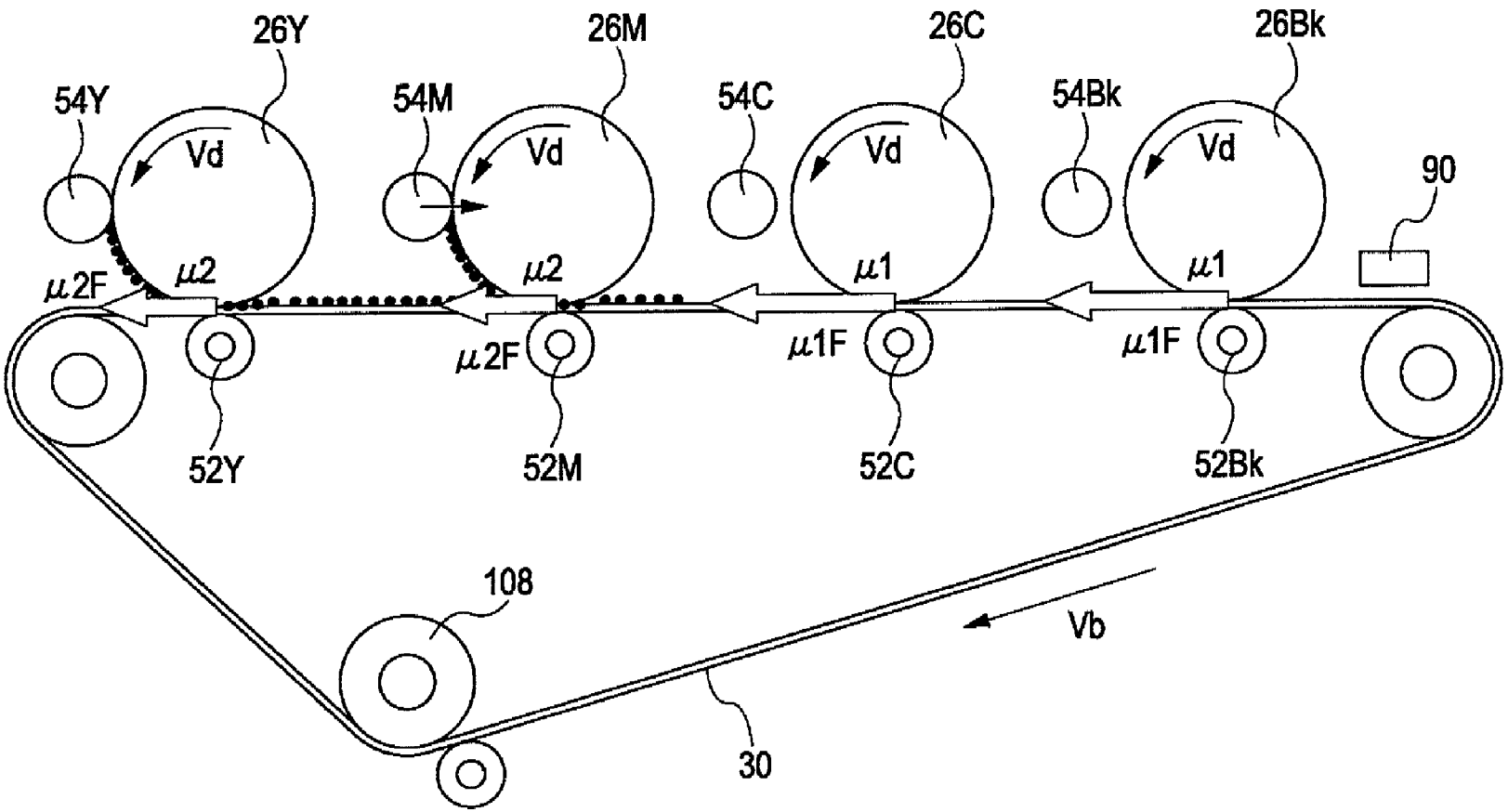
FIG. 15 (PRIOR ART)
FIG. 15 is a diagram illustrating the state in which load torque is applied to the belt.
Figure 16:
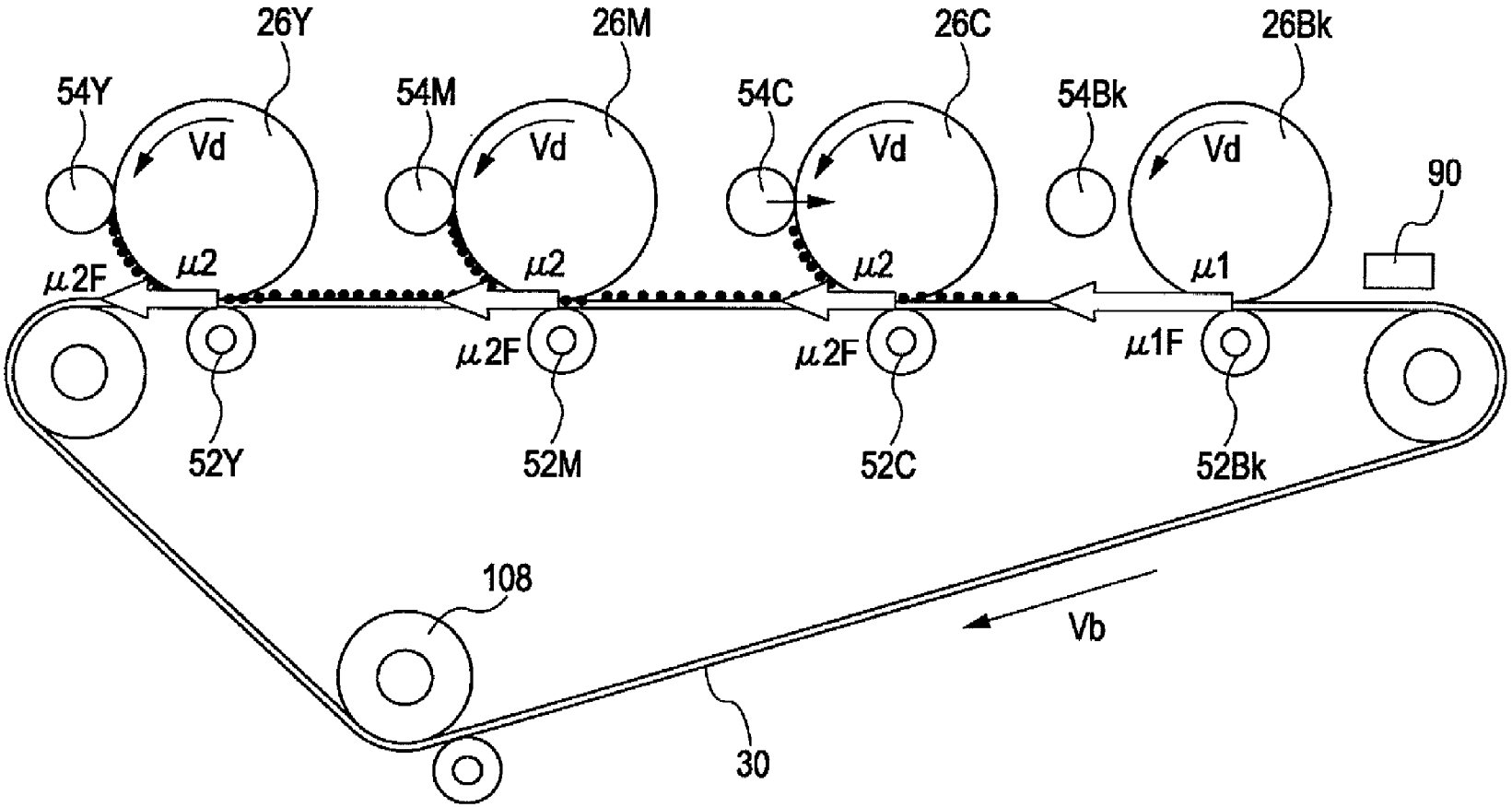
FIG. 16 (PRIOR ART)
FIG. 16 is a diagram illustrating the state in which load torque is applied to the belt.
Figure 17:
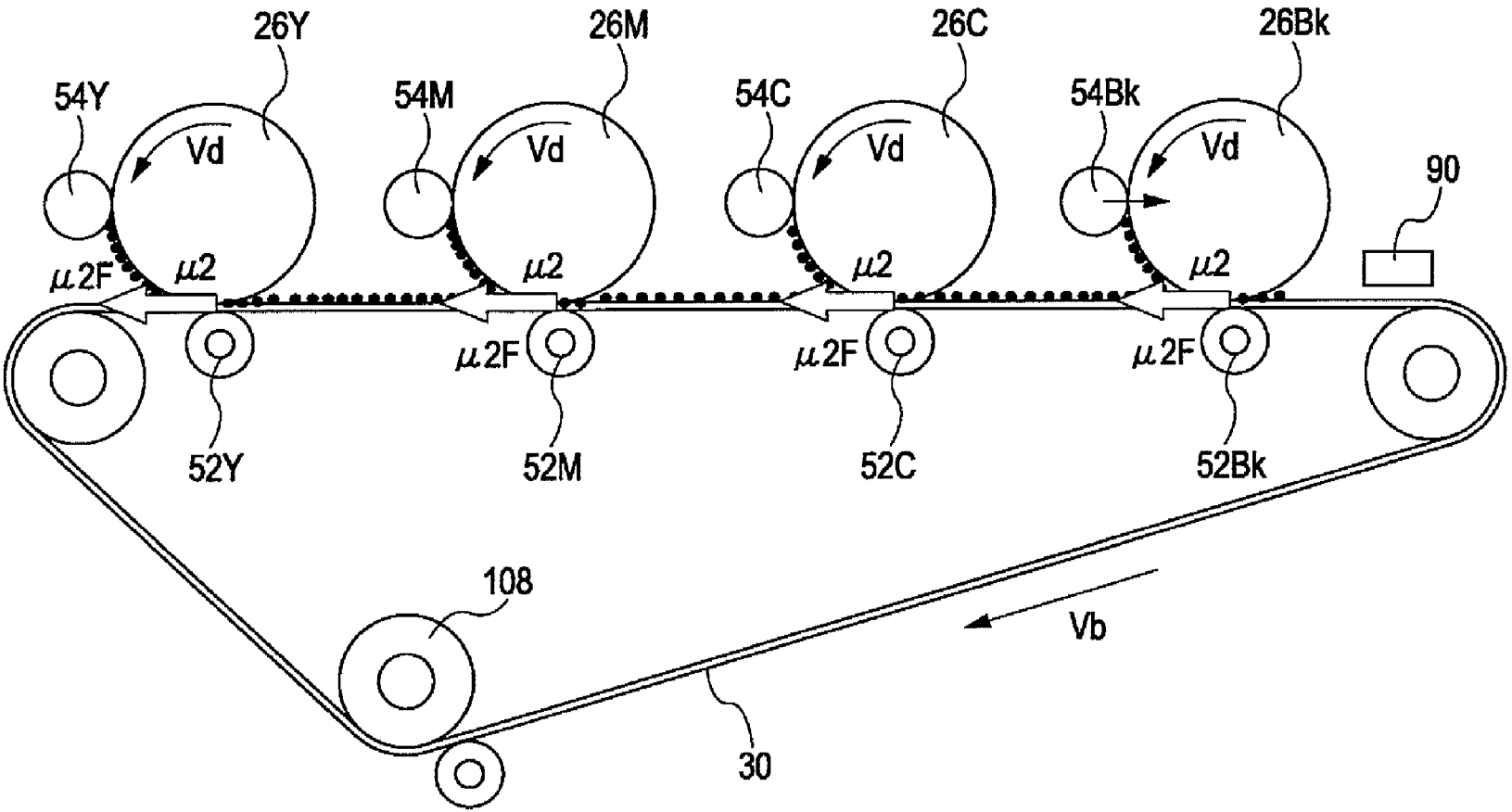
FIG. 17 (PRIOR ART)
FIG. 17 is a diagram illustrating the state in which load torque is applied to the belt.
Figure 18:
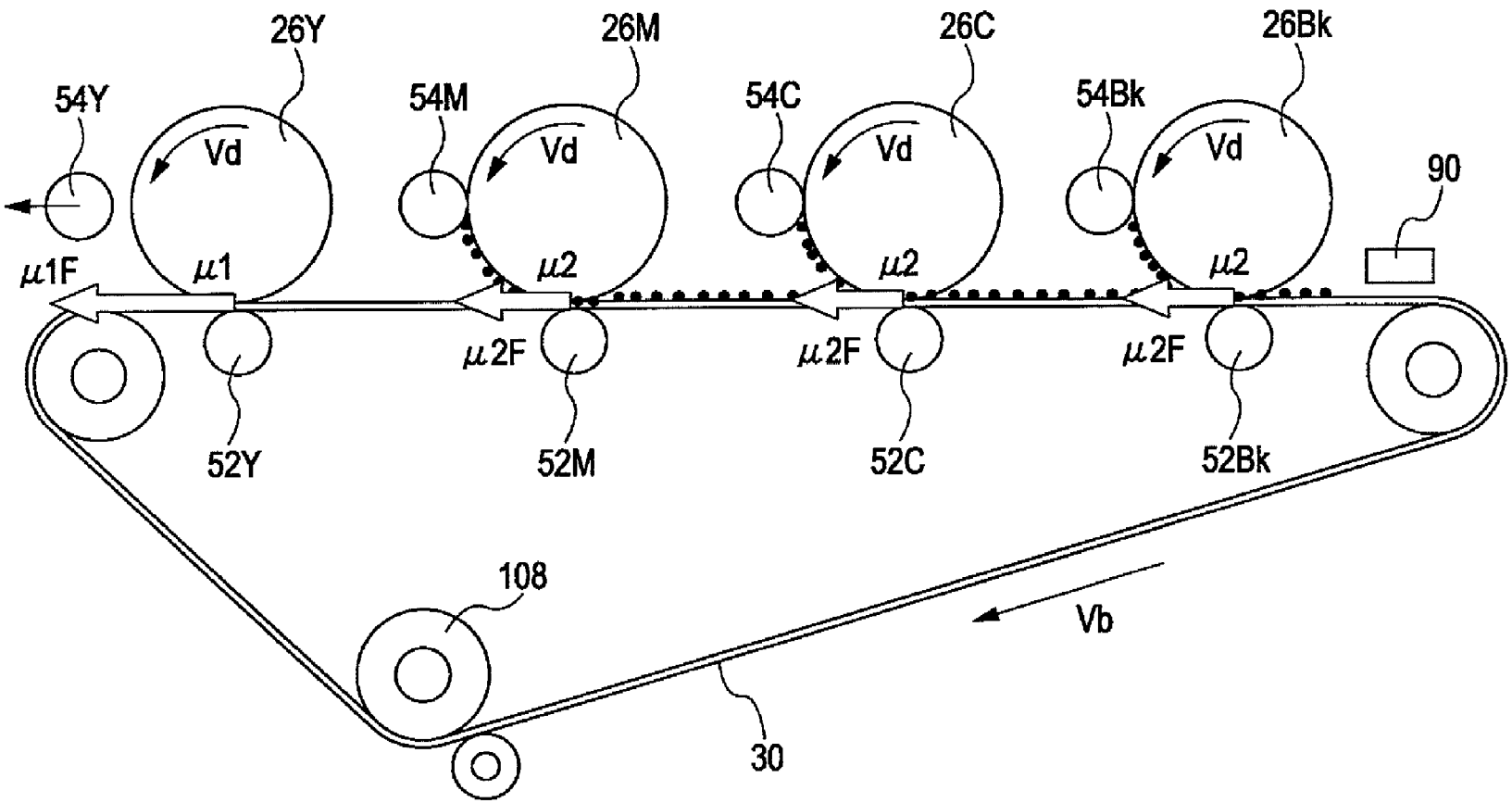
FIG. 18 (PRIOR ART)
FIG. 18 is a diagram illustrating the state in which load torque is applied to the belt.
Figure 19:
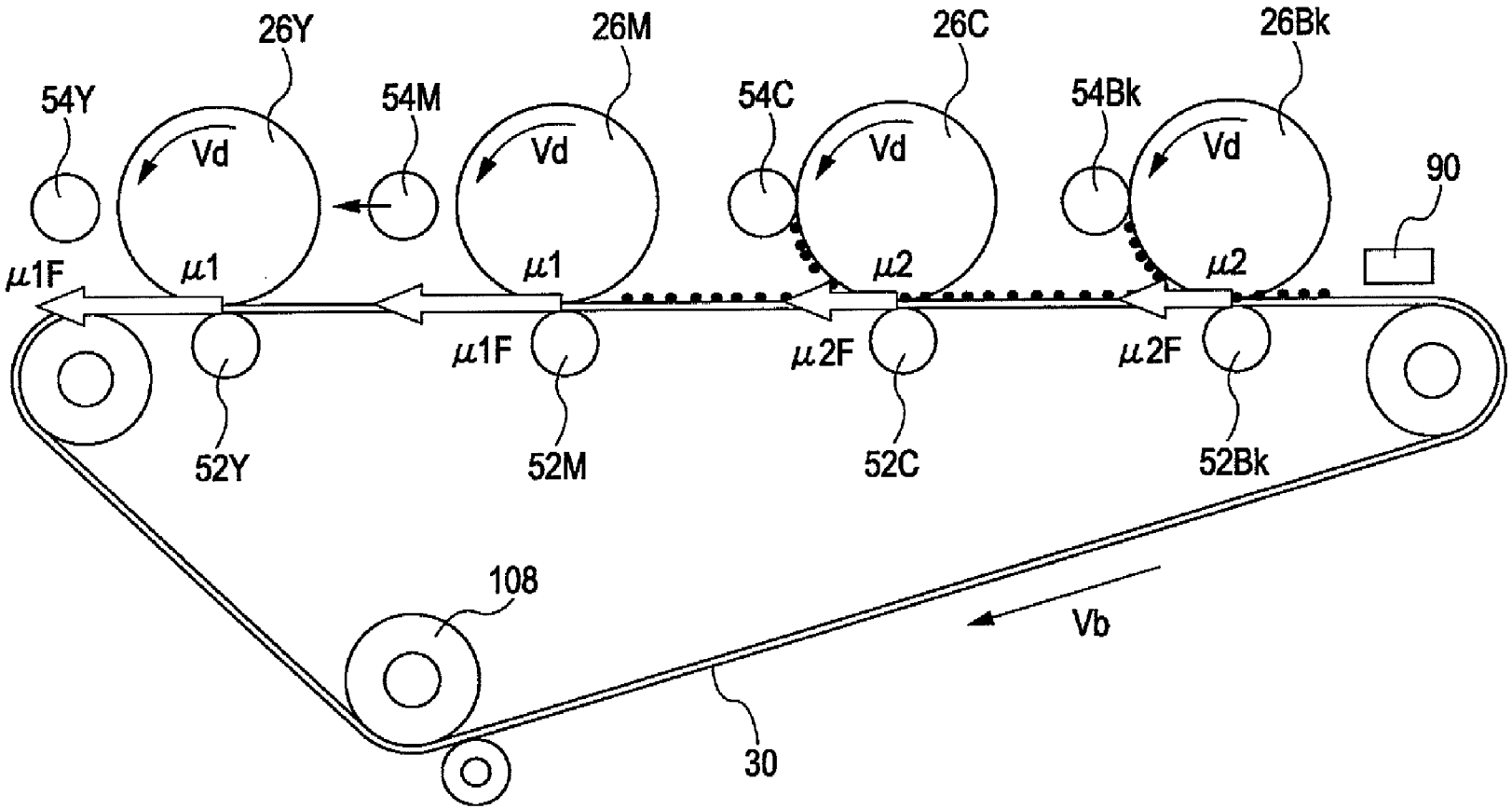
FIG. 19 (PRIOR ART)
FIG. 19 is a diagram illustrating the state in which load torque is applied to the belt.
Figure 20:
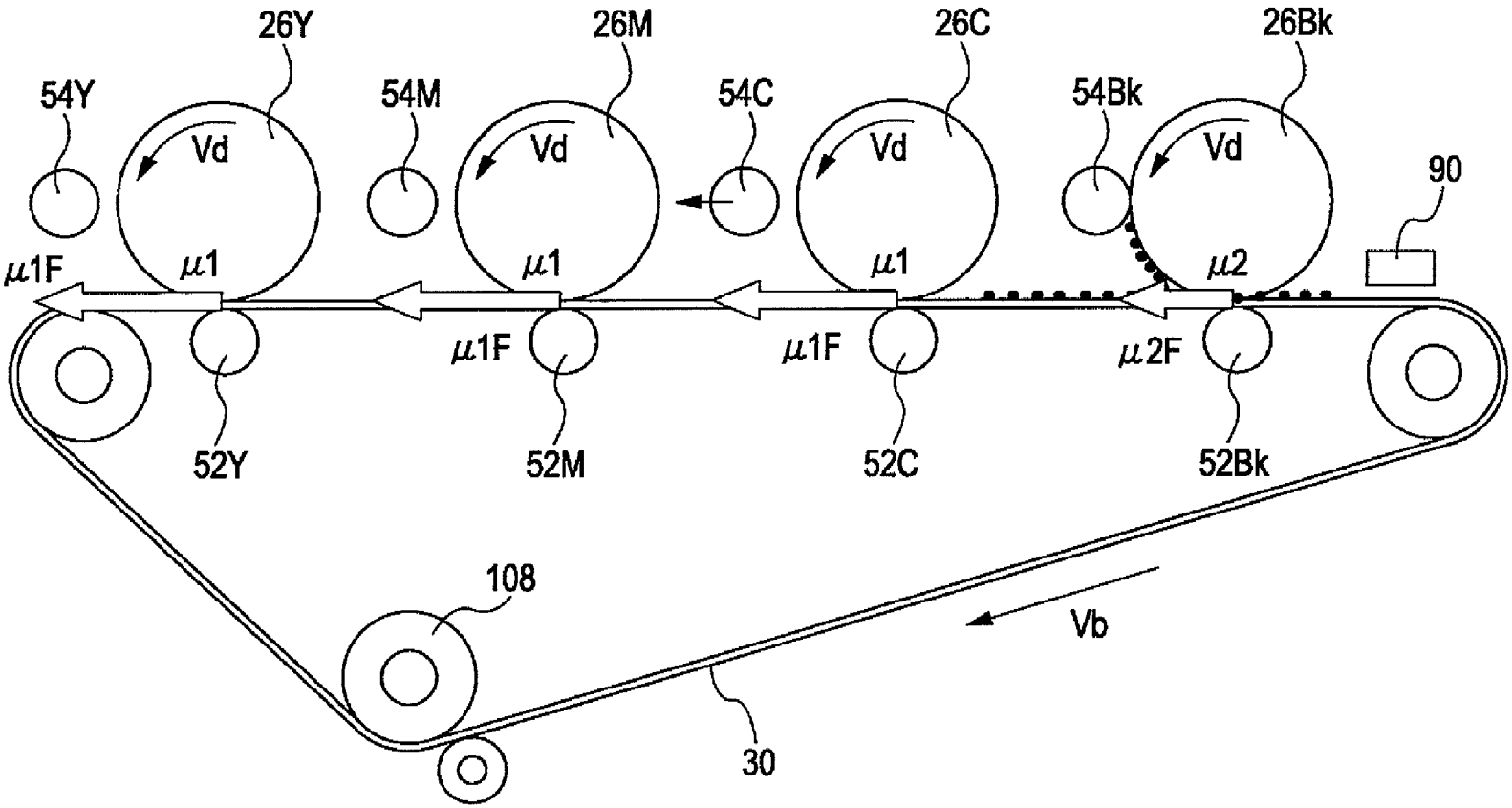
FIG. 20 (PRIOR ART)
FIG. 20 is a diagram illustrating the state in which load torque is applied to the belt.

As an example, a case is considered in which there is a difference in peripheral velocity between the photosensitive drums and the intermediate transfer belt and the torque varies as shown in FIG. 10.

Referring to FIG. 5, first and second toner patch patterns TP1 and TP2 are successively formed on the intermediate transfer belt 30 at the timing shown in FIG. 10.

In FIG. 10, TM1 shows the time when the process of successively bringing the developing devices into contact with the respective photosensitive drums is completed. In addition, TM2 shows the time when the developing device for yellow is separated from the corresponding photosensitive drum in the image forming unit for yellow in the process of forming the second toner patch pattern.

In the actual process, after the toner patches formed on the intermediate transfer belt 30 are detected by the registration detection sensors 90, the toner patches are removed by the belt cleaner (not shown) disposed near the drive roller 100. Therefore, in the actual process, the toner patches are not on the intermediate transfer belt 30 when the intermediate transfer belt 30 is at the position shown in FIG. 5. However, the toner patches are shown in the figure for convenience of explanation.

When the image forming operation is started, the developing rollers 54 for the respective colors are successively brought into contact with the respective photosensitive drums 26. Then, when a predetermined time period (for example, 5 seconds) elapses after the last developing roller 54 is brought into contact with the corresponding photosensitive drum 26, the process of forming the first toner patch pattern TP1 is started. First, after the predetermined time period, an image forming operation for forming toner patches TY1F and TY1R with the yellow process cartridge PY is started. Thus, the toner patches TY1F and TY1R are first toner patches which are transferred onto the intermediate transfer belt 30 from the corresponding photosensitive drum 26 while all of the developing rollers 54 for the respective colors are in contact with the respective photosensitive drums 26. The toner patches TY1F and TY1R shown in FIG. 5 are formed on the intermediate transfer belt 30 at a time ty1F,R shown in FIG. 10.

Then, when a predetermined time period elapses after the time ty1F,R, toner patches TBk1F, TBk1R, TBk2F, and TBk2R are formed on the intermediate transfer belt 30 with the black process cartridge PBk such that the toner patches TY1F and TY1R are respectively positioned between the toner patches TBk1F and TBk2F and between the toner patches TBk1R and TBk2R. Thus, the toner patches TBk1F, TBk1R, TBk2F, and TBk2R are first toner patches which are transferred onto the intermediate transfer belt 30 from the corresponding photosensitive drum 26 while all of the developing rollers 54 with the respective colors are in contact with the respective photosensitive drums 26.

The toner patches TBk1F and TBk1R shown in FIG. 5 are formed on the intermediate transfer belt 30 at a time tbk1F,R shown in FIG. 10. The toner patches TBk2F and TBk2R 5 are formed on the intermediate transfer belt 30 at a time tbk2F,R shown in FIG. 10.

Thus, the first toner patch pattern TP1 including the toner patches TY1F, TY1R, TBk1F, TBk1R, TBk2F, and TBk2R, which are the first toner patches, is formed on the intermediate transfer belt 30 while all of the developing rollers 54 are in contact with the respective photosensitive drums 26. Thus, the first toner patch pattern TP1 includes only the first toner patches.

The toner patches TBk1F and TBk2F are formed on the belt 30 at positions shifted upstream and downstream from the toner patch TY1F by the same distance in the rotational direction of the belt 30. Similarly, the toner patches TBk1R and TBk2R are formed on the belt 30 at positions shifted upstream and downstream from the toner patch TY1R by the same distance in the rotational direction of the belt 30.

As shown in FIG. 10, the first toner patch pattern TP1 is formed on the intermediate transfer belt 30 after all of the developing rollers are brought into contact with the respective photosensitive drums. Therefore, the transient torque variation due to the difference in peripheral velocity between the belt and the drums does not occur. In other words, the first toner patch pattern TP1 is formed in the state in which the transient velocity variation of the intermediate transfer belt does not occur.

Formation of Second Toner Patch Pattern

Next, when the intermediate transfer belt 30 rotates about substantially one turn after the first toner patch pattern TP1 is formed, the second toner patch pattern TP2 is formed. First, toner patches TY2F and TY2R are formed with the yellow process cartridge PY. The toner patches TY2F and TY2R shown in FIG. 5 are formed on the intermediate transfer belt 30 at a time ty2F,R shown in FIG. 10. Immediately after the toner patches TY2F and TY2R are transferred onto the intermediate transfer belt 30, the developing device 51 for yellow is separated from the corresponding photosensitive drum 26. Thus, the toner patches TY2F and TY2R are first toner patches which are transferred onto the intermediate transfer belt 30 from the corresponding photosensitive drum 26 while all of the developing rollers 54 for the respective colors are in contact with the respective photosensitive drums 26.

Then, when a predetermined time period elapses after the time ty2F,R, toner patches TBk3F, TBk3R, TBk4F, and TBk4R are formed on the intermediate transfer belt 30 with the black process cartridge PBk such that the toner patches TY2F and TY2R are respectively positioned between the toner patches TBk3F and TBk4F and between the toner patches TBk3R and TBk4R. The toner patches TBk3F and TBk3R shown in FIG. 5 are formed on the intermediate transfer belt 30 at a time tbk3F,R shown in FIG. 10. The toner patches TBk4F and TBk4R shown in FIG. 5 are formed on the intermediate transfer belt 30 at a time tbk4F,R shown in FIG. 10. As described above, the toner patches TBk3F, TBk3R, TBk4F, and TBk4R are formed by the black process cartridge PBk in the state in which one or more of the developing devices 51 are already separated from the respective photosensitive drums 26.

Thus, the toner patches TBk3F, TBk3R, TBk4F, and TBk4R are second toner patches which are transferred onto the intermediate transfer belt 30 from the corresponding photosensitive drum 26 while one or more of the developing devices 51 are in contact with or separated from the respective photosensitive drums 26. Immediately after the toner patches TBk3F, TBk3R, TBk4F, and TBk4R are transferred onto the intermediate transfer belt 30, the black developing device 51 is separated from the corresponding photosensitive drum 26.

Thus, the second toner patch pattern TP2 including the toner patches TY2F and TY2R, which are the first toner patches, and the toner patches TBk3F, TBk3R, TBk4F, and TBk4R, which are the second toner patches, is formed on the intermediate transfer belt 30 while the developing rollers 54 are being successively separated from the respective photosensitive drums 26. Thus, the second toner patch pattern TP2 includes both the first toner patches and the second toner patches.

The toner patches TBk3F and TBk4F are formed on the belt 30 at positions shifted upstream and downstream from the toner patch TY2F by the same distance in the rotational direction of the belt 30. Similarly, the toner patches TBk3R and TBk4R are formed on the belt 30 at positions shifted upstream and downstream from the toner patch TY2R by the same distance in the rotational direction of the belt 30.

As described above, among the toner patches formed on the intermediate transfer belt 30, the toner patches TBk3F, TBk3R, TBk4F, and TBk4R, which are the second toner patches, are formed immediately after the process of separating the developing device 51 for yellow is started. In other words, the above-mentioned toner patches are formed while the torque is being transiently varied due to the difference in peripheral velocity between the belt and the drums, which occurs immediately after the time when the process of successively separating the developing devices is started. Therefore, the intermediate transfer belt velocity at the time when the toner patches TY2F and TY2R, which are the first toner patches, are formed differs from the that at the time when the toner patches TBk3F, TBk3R, TBk4F, and TBk4R, which are the second toner patches, are formed. In other words, the second toner patch pattern TP2 is formed while the intermediate transfer belt velocity is being transiently varied.

The amount of color misregistration (first displacement) between yellow (first toner patches) and black (first toner patches) in the state in which the intermediate transfer belt velocity is not being transiently varied can be obtained by detecting the first toner patch pattern TP1 with the registration detection sensors 90. In addition, the amount color misregistration (second displacement) between yellow (first toner patches) and black (second toner patches) in the state in which the intermediate transfer belt velocity is being transiently varied can be obtained by detecting the second toner patch pattern TP2 with the registration detection sensors 90.

More specifically, referring to the graph of FIG. 4 which shows the color misregistration generated when images are successively formed on three A3-size sheets, the color misregistration in the second sheet and the rear half of the third sheet can be reproduced on the intermediate transfer belt 30 by performing the above-described image forming operation. Therefore, the difference in the peripheral velocity between the belt and the drums can be estimated by detecting the toner patches with the registration detection sensors 90.

In the present embodiment, the intervals between the process cartridges P are 95 mm, the outer diameter of each photosensitive drum 26 is ϕ30 mm, the peripheral length of the intermediate transfer belt 30 is 957 mm, and the outer diameter of the drive roller 100 is ϕ30.2 mm.

A distance TL between the toner patch patterns TP1 and TP2 shown in FIG. 5 is set to an integral multiple of the intervals 95 mm between the process cartridges, and is set such that the distance TL is as close to the peripheral length (957 mm) of the intermediate transfer belt 30 as possible. Thus, the distance TL is set to 950 mm. Accordingly, color misregistration components which relate to the drum period and unevenness in the belt thickness can be canceled and only the color misregistration caused by the difference in peripheral velocity between the belt and the drums can be determined.

Calculation of Color Misregistration

A method for calculating the amount of color misregistration on the basis of the result of detection of the toner patches formed on the belt with the registration detection sensors 90 will now be described. In the following description, the "front side" of the image forming apparatus refers to the side which faces a user when the user operates the image forming apparatus and the "rear side" of the image forming apparatus refers to the side opposite to the side which faces the user when the user operates the image forming apparatus. The toner patches positioned at the front side have the names including 'F', and the toner patches positioned at the rear side have the names including 'R'.

The registration detection sensors 90 successively detect the edges of the toner patches included in the toner patch patterns that are conveyed to the detection positions of the registration detection sensors 90, and calculate the times at which the centers of the toner patches are detected.

The time at which the center of each toner patch is detected is represented by a symbol obtained by adding 't_' to the front of the name of the toner patch. For example, the time at which the center position of the toner patch TBK1F is detected is t_TBK1F.

First, the displacement (first displacement) P_Y1 between yellow and black obtained in the state in which the process of bringing the developing devices into contact with the respective photosensitive drums is completed and there is no influence of transient torque variation (belt velocity variation) is calculated. More specifically, the amount of color misregistration (first displacement) between yellow and black in the state in which the intermediate transfer belt velocity is not being transiently varied is calculated by detecting the first toner patch pattern TP1 with the registration detection sensors 90. In the state in which the process of bringing the developing devices into contact with the respective photosensitive drums is completed and there is no influence of transient torque variation (belt velocity variation), the displacement between yellow and black at the front side of the image forming apparatus is defined YF1, and the displacement between yellow and black at the rear side of the image forming apparatus is defined as YR1. In this case, P_Y1 is defined as the average of the displacements at the front side and the rear side as follows:

$$P_Y1=(Y1F+Y1R)/2 \tag{1}$$

Here, Y1F and Y1R can be expressed as follows:

$$Y1F=t_TY1F-(t_TBk1F+t_TBk2F)/2 \tag{2}$$

$$Y1R=t_TY1R-(t_TBk1R+t_TBk2R)/2 \tag{3}$$

Thus, the first displacement P_Y1, which is the displacement between the first toner patches and the first toner patches, can be calculated from Equations (1) to (3).

Next, the displacement (second displacement) P_Y2 between yellow and black obtained in the state in which the process of separating the developing devices is started and there is an influence of transient torque variation (belt velocity variation) is calculated. More specifically, the amount of color misregistration (second displacement) of yellow with respect to black in the state in which the intermediate transfer belt velocity is being transiently varied is calculated by detecting the second toner patch pattern TP2 with the registration detection sensors 90.

In the state in which the process of separating the developing devices is started and there is an influence of transient torque variation (belt velocity variation), the displacement between yellow and black at the front side of the image forming apparatus is defined as YF2, and the displacement between yellow and black at the rear side of the image forming apparatus is defined as YR2. In this case, similar to P_Y1, P_Y2 is defined as follows:

$$P_Y2=(Y2F+Y2R)/2 \tag{4}$$

Here, Y2F and Y2R can be expressed as follows:

$$Y2F=t_TY2F-(t_TBk3F+t_TBk4F)/2 \tag{5}$$

$$Y2R=t_TY2R-(t_TBk3R+t_TBk4R)/2 \tag{6}$$

Thus, the second displacement P_Y2 can be calculated from Equations (4) to (6).

From the above-described discussion, the color misregistration P(m) generated due to the influence of transient torque variation (belt velocity variation) after the completion of the process of bringing the developing devices into contact with the respective photosensitive drums and after the start of the process of separating the developing devices from the respective photosensitive drums is calculated as follows:

$$P(m)=P_Y2-P_Y1 \tag{7}$$

If, for example, the displacement P_Y1 obtained in the state in which the intermediate transfer belt velocity is not being transiently varied is 0, in other words, if the displacement in the first toner patch pattern is 0, the color misregistration P(m) can be expressed as follows:

$$P(m)=P_Y2 \tag{18}$$

To improve the accuracy of the detection result, the detection of the color misregistration P(m) is repeated three times and the average value is determined as the amount of detected color misregistration R. Here, m shows the number of times the detection is repeated.

In the above described process, the amount of color misregistration generated due to the belt velocity variation when the developing devices are successively removed from the respective photosensitive drums is determined. However, the amount of color misregistration generated due to the belt velocity variation when the developing devices are successively brought into contact with the respective photosensitive drums may also be determined by a similar process.

In other words, referring to FIG. 4, the toner patch patterns may be formed after the image forming sequence is changed such that the color misregistration generated in the front half of the first sheet and the color misregistration generated in the second sheet can be detected. Also in this case, the amount of color misregistration can be determined.

In addition, both of the amounts of color misregistration generated when the developing devices are brought into contact with the respective photosensitive drums and the amount of color misregistration generated when the developing devices are separated from the respective photosensitive drums can be determined by increasing the length of the toner patch patterns by the above distance TL. In such a case, although the detection time will be increased in accordance with the increase in the length of the toner patch pattern, a high S/N ratio can be obtained in the process of determining the amount of color misregistration.

Figure 6:
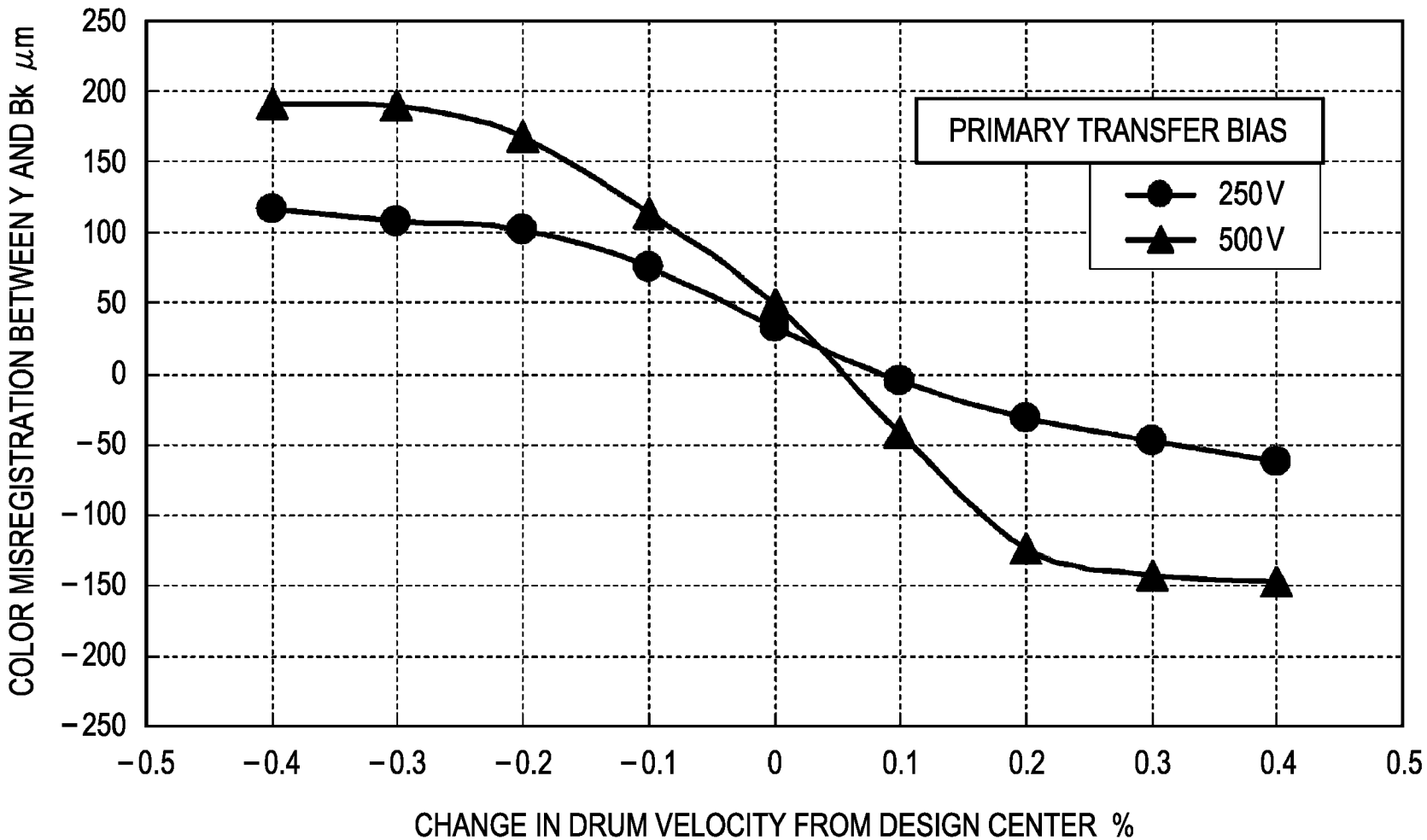
FIG. 6 is a graph showing the relationship between the drum velocity and the color misregistration between yellow and black.

FIG. 6 is a graph showing the amount of color misregistration that is actually determined by the method for calculating the amount of color misregistration according to the present embodiment. In FIG. 6, the vertical axis shows the amount of color misregistration [μm] between yellow and black and the horizontal axis shows the change [%] in the drum velocity from the design center value thereof when the design center value is 0.

Since it is difficult to experimentally change the difference in peripheral velocity between the belt and the drums, the result shown in FIG. 6 shows the relationship between the difference in peripheral velocity and the color misregistration obtained by changing the speed of the drum drive motor. The influence caused when the primary transfer bias is changed is also shown in FIG. 6.

Referring to FIG. 6, as the difference in peripheral velocity between the belt and the drums increases, the amount of color misregistration between yellow and black also increases. In addition, the amount of color misregistration also increases when the primary transfer bias is increased. However, it is clear from the graph that if the difference in peripheral velocity is excessively increased, the amount of color misregistration reaches the limit thereof.

Here, the variable ranges of the velocities of the drum and belt are about ±0.1% in design, and the difference in peripheral velocity between the belt and the drums which can be expected to occur in practice is about ±0.2%. Referring to FIG. 6, in the range of ±0.2% on the horizontal axis, the relationship between the change in the drum velocity and the amount of color misregistration is substantially linear. Therefore, the current difference in peripheral velocity between the belt and the drums can be estimated on the basis of the determined amount of color misregistration, and the peripheral velocity of the drums which is to be set to reduce the color misregistration to 0 can be calculated.

The amount of color misregistration increases as the primary transfer bias is increased (see FIG. 6). However, even when the primary transfer bias was increased, dispersion of the detected amount of color misregistration obtained as a result of each measurement was not increased. Therefore, in the process of detecting the amount of color misregistration, the primary transfer bias is set to a value higher than that in a normal image forming operation. Accordingly, the detection accuracy of the color misregistration can be increased. In practice, the primary transfer bias is controlled by a constant current control process. Therefore, in the process of forming the toner patch patterns for detecting the amount of color misregistration, the target current value is set to a value (25 μA in this example) higher than that set in the normal image forming operation. Here, it can be considered that the amount of color misregistration increases as the primary transfer bias increases due to the following reason. That is, when the primary transfer bias is increased, the electrostatic attractive force between the primary transfer roller 52 and the photosensitive drum 26 increases and the frictional force significantly varies depending on whether or not the toner is present in the primary transfer nip sections. The variation in the load torque increases as the attractive force increases. In other words, even when the difference in peripheral velocity is constant, a large load torque variation occurs when a high primary transfer bias is applied. Therefore, a small color misregistration that cannot be detected when the registration detection sensors when the primary transfer bias is low can be detected when a high primary transfer bias is applied.

Correction of Drum Velocity

Figure 7:
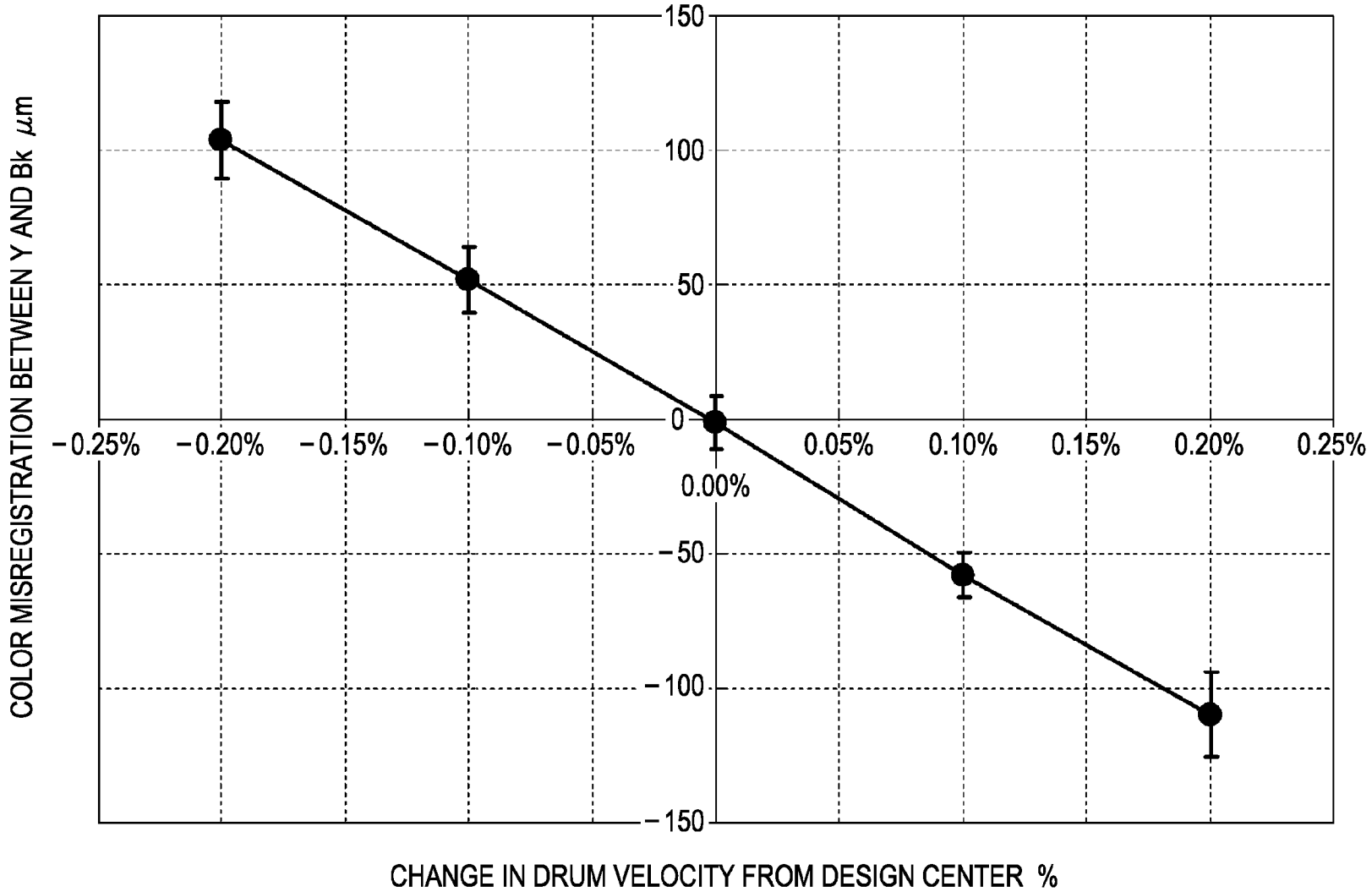
FIG. 7 is a graph showing the relationship between the drum velocity and the color misregistration between yellow and black.

FIG. 7 shows the relationship between the difference in peripheral velocity and the color misregistration obtained within the actually expected range of difference in peripheral velocity when the resistance of the intermediate transfer belt is a typical resistance value and a target primary-transfer current is a typical current value (25 μA in this example). In FIG. 7, the vertical axis shows the color misregistration [μm] between yellow and black, and the horizontal axis shows the change [%] in the drum velocity from the design center value thereof when the design center value is 0.

A correction coefficient D for correcting the drum velocity was set to 0.002%/μm from the inclination of the graph shown in FIG. 7. In this example, the correction coefficient D for the drum velocity is set as described above from the inclination of the graph shown in FIG. 7. However, the correction coefficient D is not limited to this, and may be suitably set in accordance with the structure of the apparatus. The average R [μm] of the amounts of color misregistration obtained by repeating the detection m times is calculated, and the amount of correction of the drum velocity is calculated by multiplying the average amount of color misregistration R by the correction coefficient D for the drum velocity. Thus, the corrected drum velocity Vd is calculated as follows:

$$Vd=(100+D\times R)/100\times Vd_def \quad (9)$$

In the above equation, Vd shows the calculated photosensitive drum velocity [mm/s] and Vd_def is the design center value [mm/s] of the photosensitive drum velocity.

In the case where the image forming apparatus has a plurality of velocity modes, a similar velocity correction is performed for each mode. The thus calculated drum velocity Vd or the correction coefficient D of the drum velocity is stored in the ROM 122 (see FIG. 2), which is a nonvolatile memory.

As is clear from FIG. 6, in the case where the difference in peripheral velocity between the belt and the drums is ±0.2% or more, the relationship between the difference in peripheral velocity and the amount of color misregistration is outside the linear range. Therefore, it becomes necessary to prepare a process loop in which the measurement of the amount of color misregistration and the correction of drum velocity are repeated instead of simply performing the correction of drum velocity once.

In this example, the above-described control process for correcting the drum velocity is automatically executed when the process cartridges are replaced or when a new intermediate transfer belt unit is used. However, the above-described control process for correcting the drum velocity may also be performed as necessary when the drum velocity or the velocity of the intermediate transfer belt is expected to change. For example, the control process may be performed when the environment is changed, when the temperature in the apparatus is increased, or when the degree of exhaustion reaches a certain level. In such a case, the generation of color misregistration can be reliably suppressed.

The flow of the control process for correcting the drum velocity will be described below with reference to the flowchart shown in FIG. 8.

Figure 8:
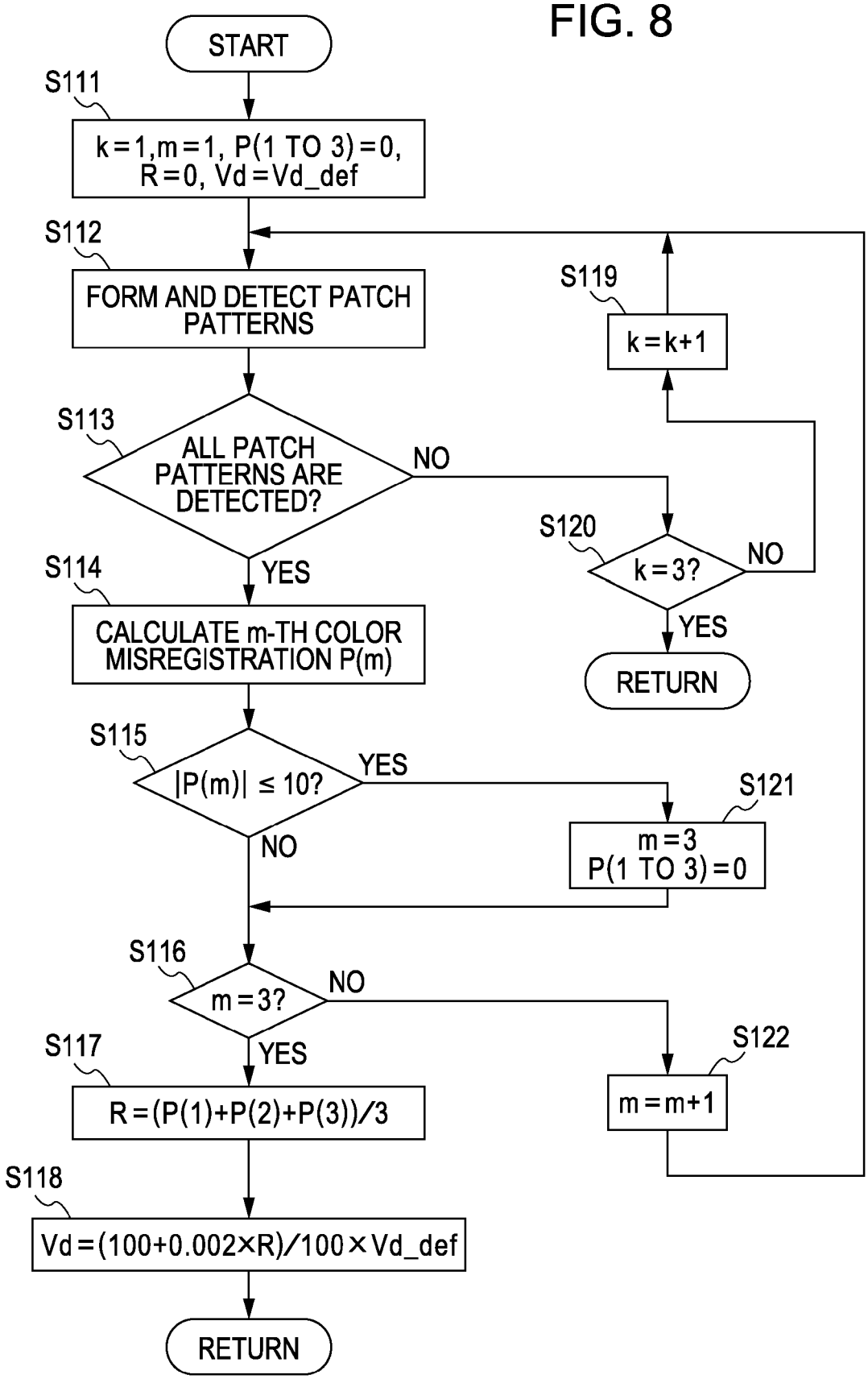
FIG. 8 is a flowchart of a drum-velocity correction sequence performed in the image forming apparatus.

Variables used in the flowchart shown in FIG. 8 are defined as follows. That is, k is a retry number counter (up to 3) which is incremented when the detection of toner patch patterns fails, m is the color-misregistration detection number counter (up to 3), P(m) is the calculation result of the amount of color misregistration [μm] obtained as a result of $m^{th}$ detection, R is the average [μm] of the amounts of color misregistration obtained by repeating the detection m times, Vd is the drum velocity [mm/s], and Vd_def is the design center value [mm/s] of the drum velocity.

When the replacement of process cartridges or a new intermediate transfer belt unit is detected, the sequence for correcting the drum velocity according to the flowchart shown in FIG. 8 is executed.

First, the variables are initialized in step S111, and the drum velocity Vd is set to the design center value.

Next, the above-described toner patch patterns are formed in step S112, and the times at which the toner patches have passed by the registration detection sensors 90 are stored in the RAM 123. More specifically, the first toner patch pattern including a plurality of toner patches is formed while the load is not being transiently varied, and then the second toner patch pattern including a plurality of toner patches is formed while the load is being transiently varied. The thus-formed toner patch patterns are detected and the detection results are stored in the RAM 123.

In the present embodiment, each toner patch pattern includes an unfixed toner image formed of a single yellow patch and two black patches with the yellow patch positioned therebetween. The state in which the load is not being transiently varied refers the state in which the developing devices are not brought into contact with or separated from the respective drums while the two kinds of toner patches for detecting the amount of color misregistration are being formed. The state in which the load is being transiently varied refers the state in which the developing devices are brought into come into contact with or separated from the respective drums while the yellow toner patch and the black toner patches are being formed.

In the case where the amount of color misregistration in the state in which the load is not being transiently varied is small enough to be ignored in the image forming operation, it is not necessary to form the first toner patch pattern in step S112. In such a case, only the second tone patch pattern can be formed while the load is being transiently varied.

In step S113, it is determined whether or not the edges of all of the toner patches in the toner patch patterns are detected. The determination is made on the basis of whether or not the number of detected edges is equal to the expected number.

If it is determined that a detection failure has occurred in step S113, the process proceeds to step S120 and it is determined whether or not the retry number counter k is equal to 3. If it is determined that the retry number counter k is 3 in step S120, that is, if the retry process is performed twice in response to the detection failure, the sequence for correcting the drum velocity is ended. In this case, the drum velocity Vd is continuously set to the design center value Vd_def. If the retry number counter k is less than 3, the retry number counter k is incremented (the integer variable is increased by 1) in step S119 and the process of forming and detecting the toner patch patterns is repeated.

If it is determined that the edges of all of the toner patches of the toner patch patterns are detected in step S113, the process proceeds to step S114 and the color misregistration P(m) for the $m^{th}$ detection cycle is calculated using the data stored in the RAM 123 on the basis of Equations (1) to (6) and (7). In the case where only the second toner patch pattern is formed in step S112, the color misregistration P(m) for the $m^{th}$ detection cycle is calculated on the basis of Equations (1) to (6) and (18).

More specifically, the amount of color misregistration generated due to the influence of transient torque variation (belt velocity variation) after the completion of the process of bringing the developing devices into contact with the respective photosensitive drums and after the start of the process of separating the developing devices from the respective photosensitive drums is calculated from the data stored in the RAM 123.

Next, in step S115, it is determined whether or not the absolute value of the calculated color misregistration P(m) is equal to or less than a predetermined value (10 μm in this example). The predetermined value (10 μm in this example) to be compared with the color misregistration P(m) is set in advance. If it is determined that the absolute value of the color misregistration P(m) is equal to or less than the predetermined value in step S115, it is determined that the difference in peripheral velocity is not large enough to cause the color misregistration. Accordingly, the process proceeds to step S121 and it is determined that it is not necessary to change the drum velocity. If it is determined that the color misregistration is sufficiently small, the sequence for correcting the drum velocity is stopped immediately so that the correction time can be reduced. Variation in the detected amount of color misregistration caused when the detection process is repeated is experimentally determined to be about 30 μm. Therefore, if the detected amount of color misregistration is 10 μm or less, it can be expected that the maximum amount of color misregistration that can actually occurs is 40 μm or less. In addition, in the actual image forming operation, the primary transfer bias is set to a value lower than that in the process of detecting the color misregistration. Therefore, the color misregistration does not cause a problem in the actual image forming operation. For this reason, according to the present embodiment, the threshold used to determine whether or not to end the detection of color misregistration is set to 10 μm.

If the absolute value of the amount of color misregistration P(m) counted in step S114 is greater than the predetermined value (10 μm in this example), the process proceeds to step S116 and it is determined whether or not the color-misregistration detection number counter m is equal to 3. If it is determined that the color-misregistration detection number counter m is less than 3 in step S116, the process proceeds to step S122 and the color-misregistration detection number counter m is incremented (step S122). Then, the process returns to step S112 and the detection of color misregistration is performed for the $m^{th}$ time.

If it is determined that the color-misregistration detection number counter m is equal to 3 in step S116, that is, if the detection of color misregistration P(m) is repeated three times, the process proceeds to step S117 and the average R of the amounts of color misregistration obtained by repeating the detection three times is calculated.

Then, in step S118, the updated drum velocity Vd at which the difference in peripheral velocity between the belt and the drums can be reduced is calculated on the basis of Equation (9) using the average amount of color misregistration R. The thus-obtained calculation result is stored in the ROM 122, which is a nonvolatile memory. The image forming operation is performed with the thus-obtained drum velocity Vd until the sequence for correcting the drum velocity is executed again.

By performing the above-described control process for correcting the drum velocity, the difference in peripheral velocity between the belt and the drums can be set within a predetermined range (about 0.05% or less in this example). Accordingly, the transient variation in the velocity of the intermediate transfer belt which occurs due to the difference in peripheral velocity between the belt and the drums can be suppressed. Therefore, the color misregistration in the leading-end section of the image on the first sheet and the trailing-end section of the image on the last sheet can be reduced without reducing the yield of the image forming apparatus. For example, the color misregistration due to the difference in peripheral velocity between the intermediate transfer belt and the photosensitive drums when the environment is changed, when the degree of exhaustion is changed, or when the temperature in the apparatus is increased can be reduced. Therefore, high-quality images can be reliably output.

A second embodiment of the present invention will be described below referring to the drawings. In the above-described embodiment, the velocity of the photosensitive drums 26 is corrected to reduce the color misregistration due to the difference in peripheral velocity between the intermediate transfer belt 30 and the photosensitive drums 26.

According to the present embodiment, in an image forming apparatus in which the variation range of steady velocity of the intermediate transfer belt (for example, ±0.2% in design) is larger than the variation range of steady velocity of the photosensitive drums (for example, ±0.1% in design), the velocity of the intermediate transfer belt 30 is corrected. Thus, the difference in peripheral velocity between the intermediate transfer belt and the photosensitive drums can be reduced. As a result, the color misregistration can be reduced and the recording accuracy of the output images can be improved. This will be described in more detail.

The structure of the image forming apparatus according to the present embodiment is similar to that of the image forming apparatus shown in FIG. 1. Therefore, explanations of components similar to those of the first embodiment will be omitted.

According to the present embodiment, in the image forming apparatus shown in FIG. 1, a rubber layer is provided on the surface of the drive roller 100 to prevent the intermediate transfer belt 30 from slipping on the drive roller 100. The fixing device 25, which serves as a heat source, is disposed below the drive roller 100 for driving the intermediate transfer belt 30. Therefore, when the image forming apparatus is continuously operated, the drive roller 100 is gradually heated and the outer diameter thereof changes accordingly. In the case where the thickness of the above-mentioned rubber layer cannot be set to a small thickness due to limitations in the manufacturing process, the change in the outer diameter cannot be ignored, and may cause a change in the rotational speed of the intermediate transfer belt 30.

As a result, the positions at which the toner images of the respective colors are superimposed on the intermediate transfer belt will be displaced from each other and color misregistration will occur. In addition, the color misregistration described in the first embodiment due to the difference in peripheral velocity between the intermediate transfer belt and the photosensitive drums will also occur. Therefore, the image quality will be degraded. In addition, the time at which the toner images transferred onto the intermediate transfer belt 30 reach the secondary transfer roller 108, which is at the secondary transfer position, also varies. Therefore, the position at which the toner images are transferred onto the recording medium Q, which is re-fed from the registration rollers 24 at a predetermined timing, will be shifted from the intended position. Such a reduction in the recording accuracy due to, for example, the displacements of print start positions at which the process of printing an image on the recording medium Q is started, must be reduced to ensure the image quality in, in particular, the image forming apparatus capable of performing duplex printing as in the present embodiment.

In the image forming apparatus of the present embodiment, the variation range of the rotational speed of the intermediate transfer belt 30 is larger than that of the photosensitive drums 26 due to, for example, the manufacturing tolerances, temperature variation in the apparatus main body, or a change in the environment. In such an image forming apparatus, the color misregistration and reduction in the recording accuracy can be reduced by making the velocity of the intermediate transfer belt, which has a larger variation range, closer to the velocity of the photosensitive drums instead of making the velocity of the photosensitive drums closer to the velocity of the intermediate transfer belt.

The process of correcting the velocity of the intermediate transfer belt 30 will now be described.

The color misregistration generated due to the difference in peripheral velocity between the intermediate transfer belt and the photosensitive drums is caused by the relative velocity between the intermediate transfer belt and the photosensitive drums. Therefore, the torque variation shown in FIG. 3 and the color misregistration shown in FIG. 4 described in the first embodiment also apply to the present embodiment. Similar to the first embodiment, the state of occurrence of the color misregistration can be detected by forming the toner patch patterns shown in FIG. 5 on the intermediate transfer belt. However, in a graph corresponding to that shown in FIG. 7 according to the present embodiment, the horizontal axis shows the amount of change in the belt velocity and the curve is inclined in the opposite direction. Therefore, a flowchart of the process for correcting the velocity of the intermediate transfer belt 30 according to the present embodiment can be obtained by changing the equation in step S118 in FIG. 8 to the following equation:

$$Vb=(100-K\times R)/100\times Vb_def \quad (8)$$

In the above equation, Vb shows the calculated velocity [mm/s] of the intermediate transfer belt and Vb_def is the design center value [mm/s] of the velocity of the intermediate transfer belt. K is the correction coefficient for correcting the velocity of the intermediate transfer belt.

Similar to the above-described embodiment, by correcting the velocity of the intermediate transfer belt, the difference in peripheral velocity between the intermediate transfer belt and the photosensitive drums can be reduced. Thus, the variation in the belt velocity due to the transient torque variation can be suppressed and the color misregistration can be reduced. In addition, since the velocity of the intermediate transfer belt is corrected to be closer to the drum velocity for which the variation range of steady velocity is small, the change in the velocity of the intermediate transfer belt relative to the design center value thereof can be reduced. Therefore, the displacement of the recording position on the recording medium (reduction in the recording accuracy) can also be reduced.

Since the velocity of the intermediate transfer belt is corrected, the displacement of the image that is transferred onto the recording medium, that is, reduction in the recording accuracy, can be considerably suppressed. However, there is also a possibility that the velocity of the photosensitive drums, which serves as the target velocity in the velocity correcting process, is shifted from the design center value. In addition, there is also a possibility that the length of the intermediate transfer belt will be changed due to the increase in the temperature in the apparatus main body or the exhaustion of the intermediate transfer belt. For the above-described reasons, there may be a case in which the recording accuracy is slightly reduced even after the velocity of the intermediate transfer belt is corrected.

Therefore, according to the present embodiment, a structure for preventing the reduction in the recording accuracy is provided. This structure will be described in more detail.

FIG. 5, which has also been referred to in the above-described embodiment, is a perspective view illustrating the structure of the intermediate transfer belt unit 31.

The intermediate transfer belt 30 is rotated at the velocity Vb [mm/s] in the direction shown by the arrow. The design value of Vb is Vb=190.

According to the present embodiment, the belt restraining ribs 301 and the belt-reinforcing tape members 302 are provided on the intermediate transfer belt 30 so as to extend over the entire circumference at the edges thereof. In addition, a single position display mark 303 is disposed between one of the belt-reinforcing tape members 302 and the intermediate transfer belt 30 at a position shown in the figure. If a plurality of position display marks are provided, the waiting time for the detection can be reduced.

The position display mark 303 is white, and is formed of a square PET sheet. The length of each side of the sheet is about 8 mm, and the thickness of the sheet is 50 μm. The intermediate transfer belt 30 is made of PI, and the thickness thereof is about 80 μm. The above-mentioned material and thickness of each component are not intended to limit the structure of the present invention, and may be set arbitrarily. The position display mark may be, for example, a mark formed on the intermediate transfer belt or the belt-reinforcing tape member by printing or the like. Alternatively, the position display mark may also be a hole formed in the intermediate transfer belt or the belt-reinforcing tape member.

The mark sensor 91 is a reflective optical sensor which functions as a mark detector, and detects an upstream edge of the position display mark 303. The mark sensor 91 detects the arrival of the position display mark 303 on the basis of the difference in light intensity between light that is reflected by the surface of the intermediate transfer belt 30 and light that is irregularly reflected by the position display mark 303. In addition, the mark sensor 91 is positioned such that the mark sensor 91 can detect the position display mark 303 in the state in which the intermediate transfer belt 30 is stretched around the tension roller 105, and is supported such that the mark sensor 91 can move in accordance with the movement of the shaft of the tension roller 105.

In the present embodiment, the period at which the intermediate transfer belt 30 rotates one turn is measured in advance using the result of detection of the position display mark 303. Then, the time at which the toner images transferred onto the intermediate transfer belt 30 reach the secondary transfer roller 108, which is at the secondary transfer position, is estimated on the basis of the measured period. Thus, the time at which the recording medium Q is re-fed to the registration rollers 24 is controlled on the basis of the estimated time.

As described above, according to the present embodiment, the color misregistration can be reduced by performing the control process for correcting the velocity of the intermediate transfer belt and the process for controlling the time at which the recording medium is re-fed. In addition, the slight difference of the velocity of the intermediate transfer belt from the design center thereof can be corrected and the reduction in the recording accuracy due to the variation in the peripheral length of the intermediate transfer belt can be prevented. Thus, an image forming apparatus capable of outputting high quality images with high stability can be obtained.

Similar to the above-described first embodiment, the control process for correcting the velocity of the intermediate transfer belt according to the present embodiment can also be effectively performed when the photosensitive drums are replaced or when a new intermediate transfer belt is detected.

In addition, there may be a case in which the velocity of the intermediate transfer belt is changed from the design center thereof when the environmental temperature varies or when the temperature in the apparatus varies in a continuous sheet-feeding process. Therefore, a temperature detection unit may be disposed in the apparatus main body or at a position near the drive roller, and the control process for correcting the velocity of the intermediate transfer belt can be performed when it is detected that the temperature is increased to a certain temperature.

In addition, the control process for correcting the velocity of the intermediate transfer belt can also be performed in accordance with the pixel count or the history of the number of sheets. In such a case, the velocity variation caused by the exhaustion of the intermediate transfer belt can be corrected.

In the image forming apparatus according to the above-described embodiments, the photosensitive drums are used as image bearing members and the intermediate transfer belt is used as an intermediate transfer member. However, the present invention is not limited to this.

For example, the present invention may also be applied to an image forming apparatus including photosensitive belts as the image bearing members and an intermediate transfer drum as the intermediate transfer member. In such a case, the velocity of the photosensitive belt can be corrected by a velocity correction sequence that is similar to the above-described sequence.

In addition, in the above-described embodiments, four image forming units for different colors are used. However, the number of image forming units is not particularly limited, and may be arbitrarily determined as necessary.

In addition, in the above-described embodiments, the toner patches forming each patch pattern are formed by the image forming units at the most upstream position and the most downstream position in the rotational direction of the intermediate transfer belt because the color misregistration occurs most significantly between the image forming units at the most upstream position and the most downstream position. However, the present invention is not limited to this. The toner patches in each pattern may be formed by the image forming units for, for example, yellow and cyan, as long as the toner patches are formed by first and second image forming units of the four image units and the second image forming unit is disposed downstream of the first image forming unit in the rotational direction of the belt.

In addition, according to the above-described embodiment, each process cartridge is detachably attached to the image forming apparatus and includes a photosensitive drum, a charging device which functions as a process unit for charging the photosensitive drum, a developing device, and a cleaning member, which are formed integrally with each other. However, the process cartridge is not limited to this. For example, each process cartridge may include only the photosensitive drum and one of the charging device, the developing device, and the cleaning device, which are formed integrally with each other.

In addition, in the above-described embodiments, a printer is described as an example of an image forming apparatus. However, the present invention is not limited to this. For example, the present invention may also be applied to other types of image forming apparatuses, such as a copy machine, a facsimile machine, and a multifunction machine including the functions of the copy machine and facsimile machine.

Alternatively, the present invention may also be applied to an image forming apparatus which uses a recording-medium conveying unit and which successively superimposes the toner images of the respective colors on a recording medium while the recording medium is held by the recording-medium conveying unit. The effects similar to the above described effects can be obtained by applying the present invention to the various types of image forming apparatuses. In addition, in the above-described embodiments, the color misregistration is reduced by reducing the difference in peripheral velocity between the belt and the drums. However, the color registration can be reduced and the transfer efficiency can be improved at the same time by setting the target difference in peripheral velocity between the belt and the drums to a suitable value (for example, such that the peripheral velocity of the belt is 0.2% higher than that of the drum) instead of setting the target velocity difference to 0%.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-045519 filed Feb. 27, 2008, which is hereby incorporated by reference herein in its entirety.

What is claimed is:

1. An image forming apparatus, comprising:

a plurality of image bearing members;

a rotary member;

developing devices capable of coming into contact with and separating from the respective image bearing members, the developing devices developing toner on the corresponding image bearing members;

a patch detector configured to detect positions of toner patches, the toner patches being transferred onto the rotary member from the image bearing members, wherein a first toner patch and a second toner patch are transferred onto the rotary member from the plurality of image bearing members, the first toner patch being transferred onto the rotary member from a first image bearing member while all of the developing devices are in contact with the respective image bearing members and the second toner patch being transferred onto the rotary member from a second image bearing member while the developing device corresponding to the second image bearing member is in contact with the second image bearing member and the developing device corresponding to at least one of the plurality of image bearing members except for the second image bearing member is moving from a contact state to a separated state or moving from the separated state to the contact state; and a control device controls a peripheral velocity of the rotary member or a peripheral velocity of the image bearing members based on a position of the first toner patch and a position of the second toner patch detected by the patch detector.

2. The image forming apparatus according to claim 1, wherein a transfer bias for transferring the first toner patch and the second toner patch from the image bearing members to the rotary member is set to a value higher than a transfer bias for transferring the toner images from the image bearing members to the rotary member in a process of forming an image on a recording medium.

3. The image forming apparatus according to claim 1, wherein the rotary member is an intermediate transfer belt which carries and conveys the toner images.

4. The image forming apparatus according to claim 1, wherein the rotary member is a recording-medium conveying member which carries and conveys a recording medium.

5. The image forming apparatus according to claim 1, wherein the image forming apparatus is capable of forming a first toner patch pattern including the first toner patch and another toner patch that is different from the first toner patch and transferred onto the rotary member from an image bearing member other than the first image bearing member while all of the developing devices are in contact with the respective image bearing members, and a second toner patch pattern including the first toner patch and the second toner patch, and wherein the control device controls the peripheral velocity of the rotary member or the peripheral velocity of the image bearing members based on positions of the toner patches included in the first toner patch pattern and positions of the toner patches included in the second toner patch pattern detected by the patch detector.

6. The image forming apparatus according to claim 1, wherein the first image bearing member is disposed at a most upstream position among the plurality of image bearing members in a rotational direction of the rotary member, and wherein the second image bearing member is disposed at a most downstream position among the plurality of image bearing members in the rotational direction of the rotary member.

7. The image forming apparatus according to claim 1, wherein the second toner patch is formed each at an upstream position and at a downstream position in the rotational direction of the rotary member with respect to a position where the first toner patch is formed.

8. The image forming apparatus according to claim 7, wherein the patch detector detects a position of the first toner patch and positions of the second toner patches, and wherein the control device compares an average position of the second toner patches with the position of the first toner patch detected by the patch detector, and changes the peripheral velocity of the rotary member or the peripheral velocity of the image bearing members in a case where an amount of a displacement of the second toner patch from the first toner patch exceeds a predetermined amount.

* * * * *